US009873584B2

(12) United States Patent
Kojima et al.

(10) Patent No.: US 9,873,584 B2
(45) Date of Patent: Jan. 23, 2018

(54) MEDIUM STACKING DEVICE AND MEDIUM TRANSACTION DEVICE

(71) Applicant: Oki Electric Industry Co., Ltd., Tokyo (JP)

(72) Inventors: Ryousuke Kojima, Tokyo (JP); Hirokazu Komatsu, Tokyo (JP); Yuta Iizuka, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 0 days.

(21) Appl. No.: 15/111,490

(22) PCT Filed: Jan. 6, 2015

(86) PCT No.: PCT/JP2015/050169
§ 371 (c)(1),
(2) Date: Jul. 14, 2016

(87) PCT Pub. No.: WO2015/166668
PCT Pub. Date: Nov. 5, 2015

(65) Prior Publication Data

US 2016/0325961 A1 Nov. 10, 2016

(30) Foreign Application Priority Data

Apr. 28, 2014 (JP) ..... 2014-093007

(51) Int. Cl.
*B65H 31/34* (2006.01)
*B65H 43/04* (2006.01)
(Continued)

(52) U.S. Cl.
CPC ..... *B65H 31/34* (2013.01); *B65H 29/52* (2013.01); *B65H 31/10* (2013.01); *B65H 31/36* (2013.01);
(Continued)

(58) Field of Classification Search
CPC ..... B65H 31/34; B65H 29/52; B65H 31/10; B65H 29/46; B65H 2405/114
See application file for complete search history.

(56) References Cited

U.S. PATENT DOCUMENTS 7,661,671 B2 * 2/2010 Yamazaki ..... B65H 29/246 271/211
2009/0134565 A1 * 5/2009 Duan ..... B65H 23/24 271/93

(Continued)

FOREIGN PATENT DOCUMENTS

JP 2000-072317 A 3/2000
JP 2010-013221 A 1/2010
JP 2012-076914 A 4/2012

*Primary Examiner* — Jeremy R Severson
(74) *Attorney, Agent, or Firm* — Rabin & Berdo, P.C.

(57) ABSTRACT

A medium stacking device includes side guides that are respectively disposed in a width direction parallel to a sheet face of the medium and orthogonal to a direction of progress at positions on both sides of a portion of a stage on which a medium is stacked, and that respectively guide the medium discharged from a discharge section in the width direction using a stacking guide face. Each side guide includes a discharge guide face that guides toward a central side in the width direction on progression from the discharge section along the direction of progress, a support guide face that supports the medium from a side of the stage, and a guiding valley portion that is an adjoining portion between the discharge guide face and the support guide face, that causes a vertex or edge of the medium to slide with progression of the medium, and that causes a leading edge portion of the medium in the direction of progress to pass further to a stacking direction side than the stage arm.

9 Claims, 27 Drawing Sheets

(51) Int. Cl.

| | |
|---|---|
| ***G07D 11/00*** | (2006.01) |
| ***B65H 29/52*** | (2006.01) |
| ***B65H 31/10*** | (2006.01) |
| ***B65H 31/36*** | (2006.01) |

(52) U.S. Cl.
CPC ..... *B65H 43/04* (2013.01); *G07D 11/0021* (2013.01); *B65H 2404/1114* (2013.01); *B65H 2404/742* (2013.01); *B65H 2405/114* (2013.01); *B65H 2701/1912* (2013.01)

(56) References Cited

U.S. PATENT DOCUMENTS

| | | | | |
|---|---|---|---|---|
| 2009/0212486 | A1* | 8/2009 | Kramer | B65H 31/10 271/217 |
| 2012/0098660 | A1* | 4/2012 | Hoover | B65H 31/10 340/540 |
| 2015/0314977 | A1* | 11/2015 | Takada | B65H 31/06 271/306 |

* cited by examiner

MEDIUM STACKING DEVICE AND MEDIUM TRANSACTION DEVICE

TECHNICAL FIELD

Technology disclosed herein relates to a medium stacking device and a medium transaction device that, for example, may be applied to an Automated Teller Machine (ATM) that is inserted with a paper sheet shaped medium such as banknotes and that performs a desired transaction.

BACKGROUND ART

ATMs and the like that, according to the contents of a transaction with a customer, for example, allow the customer to insert cash such as banknotes or coins, or pay out cash to the customer, are widely employed in financial institutions and the like.

For example, ATMs exist that include a pay-in/pay-out section that exchanges banknotes with a customer, a conveyance section that conveys the banknotes along a conveyance path, a classification section that classifies the banknotes by denomination, authenticity, and the like, a temporary holding section that temporarily holds banknotes, banknote storage boxes that store reusable banknotes by denomination, and a reject box that stores banknotes that are not for reuse.

In such an ATM, when a customer inserts banknotes through a customer interface in a pay-in transaction, the inserted banknotes are conveyed by the conveyance section with their short edge direction aligned with the direction of progress. Banknotes identified as normal banknotes by the classification section are stored in the temporary holding section. Banknotes identified as banknotes that are not for transaction are returned to the customer interface and given back to the customer.

Then, in the ATM, when the customer confirms a pay-in amount, the banknotes stored in the temporary holding section are fed out and their denominations are reconfirmed by the classification section, and the banknotes are stored in the respective banknote storage boxes according to their identified denominations. Banknotes identified as having a high level of damage are stored in the reject box.

For example, a reject box 517 illustrated in FIG. 25 stacks banknotes BL with their long edges positioned at the front and rear on a stage 31 that moves in an up-down direction inside an internal space 30S formed in a casing 30. More specifically, during banknote storage, the reject box 517 first aligns an upper face of the stage 31, or an uppermost face of the banknotes stacked on the stage 31 (referred to below as the uppermost stacking face) with a specific stacking height H2.

Next, the reject box 517 uses a conveyance section 34 to convey a banknote BL toward the rear, and uses a discharge section 36 to discharge the banknote BL into the internal space 30S from a discharge height H1. After the banknote BL strikes bill stoppers 41 and the impact has been absorbed, the banknote BL is tapped downward by tongue pieces 39B of tongue piece rollers 39, thereby superimposing and stacking the banknote BL on the uppermost stacking face.

In the reject box 517, a left side guide 533L and a right side guide 533R (referred to collectively below as the side guides 533) are respectively provided on both the left and right sides of the stage 31. The side guides 533 restrict the left-right direction position of the banknotes BL on the stage 31 using inside-facing stacking guide faces 554 on the left and right, neatly stacking the banknotes BL in a state pushed as close as possible to the center (see, for example, Japanese Patent Application Laid-Open (JP-A) No. 2012-76914).

The side guides 533 are side guides in which, as illustrated in FIG. 26 and FIG. 27, for example, a discharge guide face 553 is formed at an upper side, an inclined slide face 556 is formed inclined between the discharge guide face 553 and the stacking guide face 554, and an adjoining portion between the inclined slide face 556 and the discharge guide face 553 configures a guiding valley portion 557. When a banknote BL discharged from the discharge section 36 is offset toward the left direction, as illustrated in FIG. 25, the side guide 533 causes an edge portion of the banknote BL to progress by sliding against the discharge guide face 553 and the guiding valley portion 557. The side guides 533 are thereby capable of nudging the overall banknote BL gradually toward the center as a leading edge of the banknote BL approaches the bill stoppers 41.

Moreover, in the reject box 517, the side guides 533 that guide the banknotes BL are disposed very close to the stage 31, such that a moving mechanism that moves the stage 31 in the up-down direction is disposed further to the outside than the side guides 533. Accordingly, the stage 31 is provided with stage arms 31B that reach further outside than the side guides 533 on both the left and right sides of a central main placement portion 31A on which banknotes are mainly placed. The stage 31 is capable of moving in the up-down direction due to receiving drive force from the moving mechanism through the stage arms 31B.

SUMMARY OF INVENTION

Technical Problem

The size of banknotes generally differs between the country or region of issue, and often the sizes of banknotes differ between different denominations within a given country or region. Accordingly, it is conceivable that plural types of the side guides 533 in different sizes could be prepared, and the most appropriate side guides 533 installed to the reject box 517 according to the country or region where the ATM is installed, namely according to the range of lengths of the long edges of the banknotes BL that will be handled. In the interest of using common components as much as possible, common use of a single type of stage 31 is anticipated.

Note that in the side guides 533, in order for the discharge guide face 553 to slide and guide banknotes BL, an angle θ1 of the discharge guide face 553 with respect to the direction of progress is suppressed to a specific maximum angle (FIG. 27) or lower. Accordingly, in the reject box 517, when storing banknotes BL with a small (short) length in the left-right direction, the side guides 533 are set with a large length L1 in the left-right direction, and due to the constraint of the angle θ1 described above, a length L2 in the front-rear direction is also set relatively large.

In the reject box 517, interference and collisions between the side guides 533 and the stage 31 are avoided, and the gap therebetween is kept as small as possible, thereby preventing banknotes from falling through the gap. Accordingly, the shape of the stage 31 is determined so as to form a small gap between the stage 31 and side guides 533 in which the left-right direction length L1 and the front-rear direction length L2 are relatively large.

Accordingly, when storing banknotes BL with a relatively long length in the left-right direction, a left side guide 573L and a right side guide 573R (referred to collectively below as the side guides 573) are installed in the reject box 517, as illustrated in FIG. 28, for example. The lengths of the side guides 573 in the left-right direction and the front-rear direction are lengths L3 and L4 that are shorter than the respective lengths L1 and L2 of the side guides 533, thereby forming a certain gap between themselves and the stage 31.

In cases in which few banknotes are stacked on the stage 31, the reject box 517 positions an upper face of the stage 31 very close to a stacking position. In this state, in the reject box 517, when a banknote BL is discharged from the discharge section 36 offset in the left-right direction, as the banknote BL guided by a guiding valley portion 587 of the corresponding side guide 573 progresses into the internal space 30S, there is a possibility of a leading edge portion of an edge portion of the banknote BL in the direction of progress striking a front face 31BF of the stage arm 31B, and becoming unable to progress any further.

In such cases, in the reject box 517, the banknote BL that has struck the stage arm 31B cannot be stacked neatly on the stage 31 or on another banknote BL already stacked on the stage 31. Moreover, in the reject box 517, a new banknote subsequently discharged from the discharge section 36 would collide with a rear edge of the banknote BL, giving rise to the possibility of causing jams or damage to the banknotes BL, and of damage to the respective components inside the reject box 517.

Technology disclosed herein proposes a medium stacking device and a medium transaction device capable of neatly storing media of different sizes.

Solution to Problem

A medium stacking device of technology disclosed herein addressing the above issues includes: a discharge section that discharges a paper sheet shaped medium into a stacking space and moves the medium in a direction of progress; a stage that includes a placement face on which the medium is placed in the stacking space, and that stacks the medium in a stacking direction that is a direction away from the placement face; side guides that are respectively disposed in a width direction parallel to a sheet face of the medium and orthogonal to the direction of progress at positions on both sides of a portion of the stage on which the medium is stacked, and that respectively guide the medium discharged from the discharge section in the width direction using a stacking guide face; a stage moving section that moves the stage along the stacking direction such that a spacing in the stacking direction between the discharge section and the placement face of the stage is a stacking spacing appropriate for stacking the medium or greater; and a stage arm that is provided on an opposite side of the side guide to the discharge section, and that links the stage and the stage moving section together. Each side guide includes a discharge guide face that guides toward a central side in the width direction on progression from the discharge section along the direction of progress, a support guide face that supports the medium from a side of the stage, and a guiding valley portion that is an adjoining portion between the discharge guide face and the support guide face, that causes a vertex or edge of the medium to slide with progression of the medium, and that causes a leading edge portion of the medium in the direction of progress to pass further to a stacking direction side than the stage arm.

A medium transaction device of technology disclosed herein includes: a discharge section that discharges a paper sheet shaped medium transacted with a user into a stacking space and moves the medium in a direction of progress; a stage that includes a placement face on which the medium is placed in the stacking space, and that stacks the medium in a stacking direction that is a direction away from the placement face; side guides that are respectively disposed in a width direction parallel to a sheet face of the medium and orthogonal to the direction of progress at positions on both sides of a portion of the stage on which the medium is stacked, and that respectively guide the medium discharged from the discharge section in the width direction using a stacking guide face; a stage moving section that moves the stage along the stacking direction, a stage arm that is provided on a side of the side guide opposite to the discharge section, and that links the stage and the stage moving section together; and a controller that controls the stage moving section such that a spacing in the stacking direction between the discharge section and the placement face of the stage is a stacking spacing appropriate for stacking the medium or greater. Each side guide includes a discharge guide face that guides toward a central side in the width direction on progression from the discharge section along the direction of progress, a support guide face that supports the medium from a side of the stage, and a guiding valley portion that is an adjoining portion between the discharge guide face and the support guide face, that causes a vertex or edge of the medium to slide with progression of the medium, and that causes a leading edge portion of the medium in the direction of progress to pass further to a stacking direction side than the stage arm.

In the technology disclosed herein, when a medium discharged from the discharge section is offset in the width direction, the medium is moved in the direction of progress while a vertex or edge of the medium is caused to contact or slide against the discharge guide face of the side guide and the vertex is caused to follow the guiding valley portion. Accordingly in the technology disclosed herein, when a leading edge portion of the medium in the direction of progress reaches the position of the stage arm, the vertex of the medium is caused to pass further to the stacking direction side than the placement face of the stage, thereby enabling the vertex and the vicinity thereof to be moved without striking the stage arm.

Advantageous Effects of Invention

The technology disclosed herein moves the medium without the medium striking the stage arm due to causing the leading edge portion of the medium in the direction of progress to pass further to the stacking direction side than the placement face of the stage. The technology disclosed herein thereby enables a medium stacking device and a medium transaction device capable of neatly storing media of different sizes.

DESCRIPTION OF EMBODIMENTS

Explanation follows regarding embodiments for implementing the present invention (referred to below as exemplary embodiments), with reference to the drawings.

1. First Exemplary Embodiment

1-1. ATM Configuration

Figure 1:
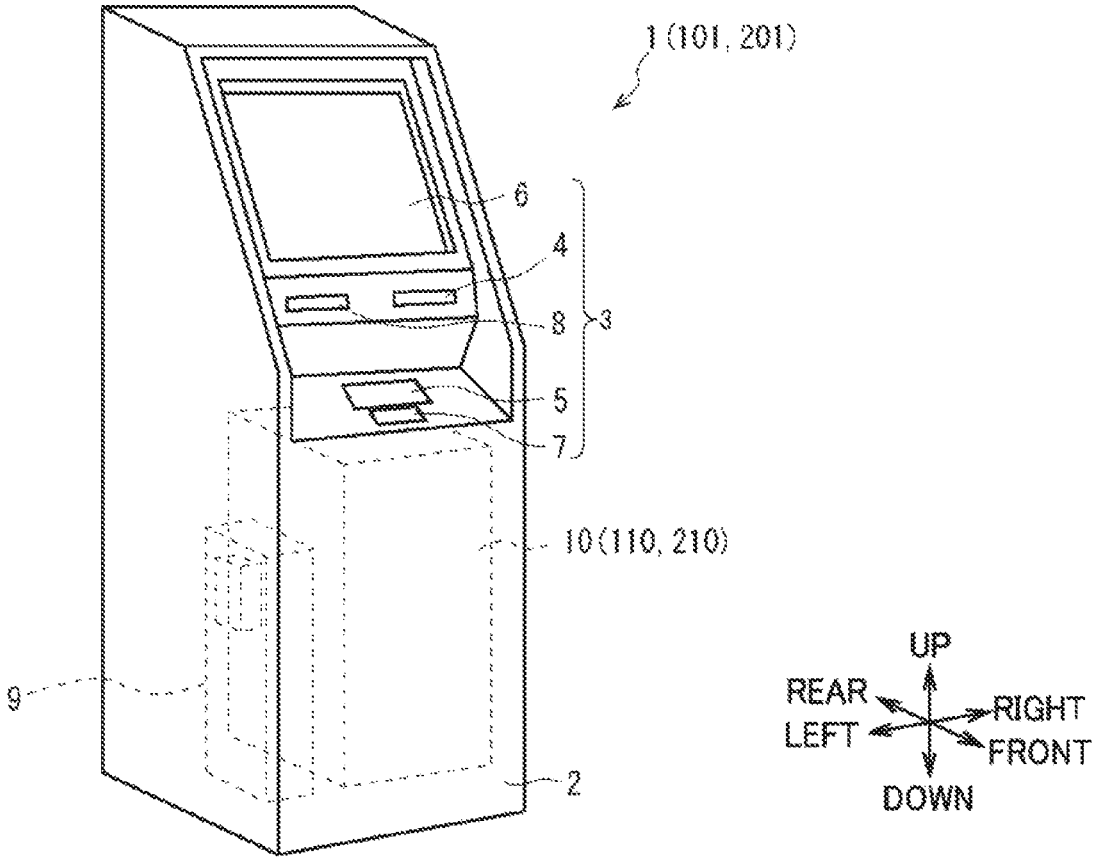
FIG. 1 is a perspective view illustrating configuration of an ATM.

As illustrated in the external view of FIG. 1, an ATM 1 includes a box-shaped casing 2, and is, for example, installed in a financial institution or the like to perform cash transactions such as pay-in transactions and pay-out transactions for a user. In the following explanation, the front side is defined as the side of the ATM 1 facing the user, and the opposite side thereto is defined as the rear side. The left side, right side, upper side and lower side are defined from the perspective of the left and right as seen by a customer facing the front side.

The casing 2 is provided with a customer interface 3 at a location enabling easy banknote insertion, easy operation of a touch panel, and the like by a customer facing the front side of the casing 2. The customer interface 3 directly handles cash and passbook transactions and the like with a user such as a customer of a financial institution, and notifies transaction-related information and receives operation instructions. The customer interface 3 is provided with a card insertion/removal port 4, a pay-in/pay-out port 5, an operation and display section 6, a ten-key 7, and a receipt issue port 8.

The card insertion/removal port 4 is a section for insertion and return of various cards, such as cash cards. A card processor that reads, for example, account numbers magnetically recorded on the various cards is provided behind the card insertion/removal port 4. The pay-in/pay-out port 5 is a section into which banknotes for paying in are inserted by a user, and where banknotes for paying out to a user are dispensed.

The operation and display section 6 is a touch panel integrated with a Liquid Crystal Display (LCD) that displays operation screens during transactions, and a touch sensor that is input with, for example, a transaction type selection, a PIN, or a transaction amount. The ten-key 7 is, for example, a physical keypad that is input with the numbers 0 to 9. The ten-key 7 is employed during PIN and transaction amount input operations and the like. The receipt issue port 8 is a section that issues a receipt printed with transaction details and the like at the end of transaction processing. A receipt processor that prints the transaction details and the like on the receipt is, for example, provided behind the receipt issue port 8.

A main controller 9 that performs general control of the overall ATM 1, a banknote pay-in/pay-out device 10 that performs various processing relating to banknotes, and the like, are provided inside the casing 2.

The main controller 9 includes a Central Processing Unit (CPU). The main controller 9 reads and executes specific programs from, for example, ROM or flash memory, to perform various processing such as in pay-in transactions and pay-out transactions. The main controller 9 is provided with an internal storage section including, for example, Random Access Memory (RAM), a hard disk drive, or flash memory. The storage section is stored with various information.

Figure 2:
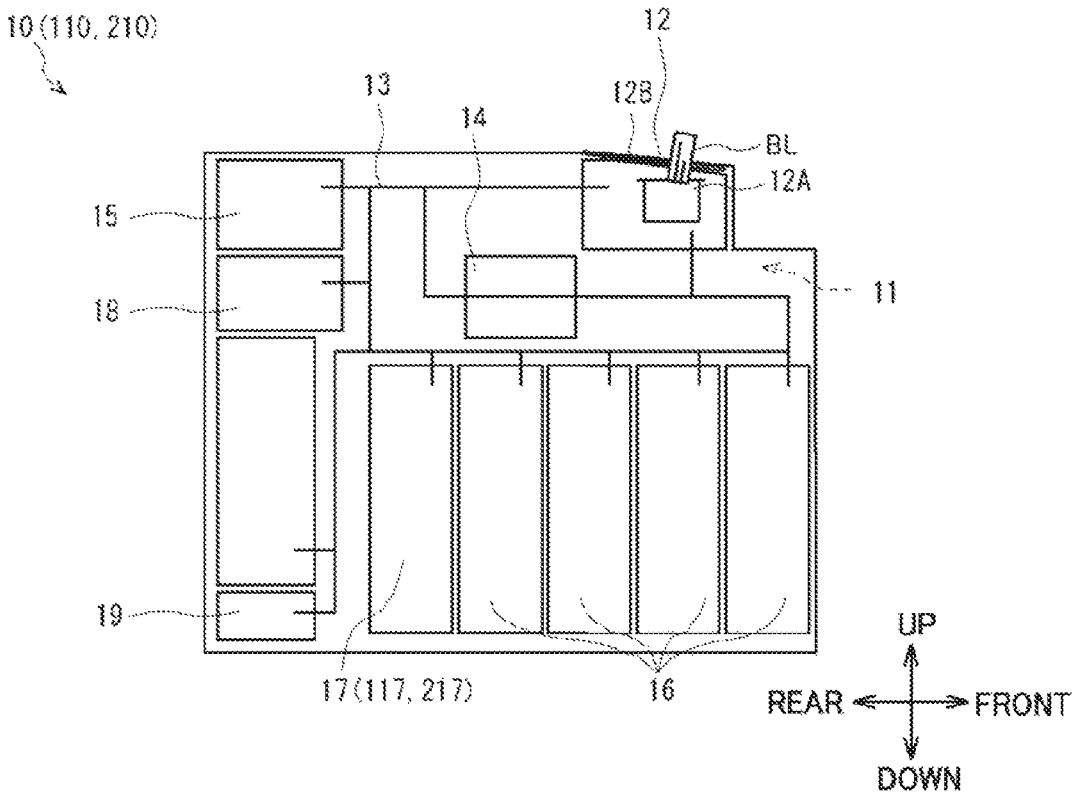
FIG. 2 is a schematic drawing illustrating configuration of a banknote pay-in/pay-out device.

As illustrated in the side view of FIG. 2, a banknote controller 11, a pay-in/pay-out section 12, a conveyance section 13, a classification section 14, a temporary holding section 15, banknote storage boxes 16, a reject box 17, a forgotten banknote storage box 18, and a counterfeit note storage box 19 are provided inside the banknote pay-in/pay-out device 10.

The banknote controller 11 performs general control of the banknote pay-in/pay-out device 10 in coordination with the main controller 9. Similarly to the main controller 9, the banknote controller 11 includes a CPU, and executes specific programs to perform various processing such as pay-in processing and pay-out processing. The banknote controller 11 is provided with an internal storage section including, for example, RAM, or flash memory. The storage section is stored with various information.

The pay-in/pay-out section 12 includes an upward-opening, box-shaped receptacle 12A. The receptacle 12A houses banknotes for passing to a user or banknotes received from a user in a state arranged in the front-rear direction. An openable and closable shutter 12B is provided above the receptacle 12A.

The conveyance section 13 forms a conveyance path connecting together the various sections inside the banknote pay-in/pay-out device 10 with motors, rollers, belts, guides, and the like. The conveyance section 13 rotates the rollers as appropriate, and moves the belts as appropriate, to convey banknotes along the conveyance path.

Banknotes are configured from paper, resin, or the like, and are formed in thin rectangular sheet shapes. The banknotes are conveyed with their short edges aligned with the direction of progress, namely with their long edges bringing up the front and rear in the direction of progress. The banknotes have a certain elasticity, and have a natural state of a state spread out in a flat plane shape. Elastic force or recovery force attempts to return the banknote to its original shape (namely the flat plane shape) when the banknote is applied with an external force and flexes from the natural state.

The classification section 14 includes various internal sensors such as optical sensors, image sensors, and magnetic sensors. Classification results from the respective sensors are obtained and supplied to the banknote controller 11 by the classification section 14 as banknotes are conveyed through the inside. In response, for example, the banknote controller 11 determines the denomination, authenticity, extent of damage, and the like of each banknote based on the obtained classification results, and by comparing a read serial number against a list of counterfeit note serial numbers, and then decides a conveyance destination for the banknote.

Under the control of the banknote controller 11, the temporary holding section 15 stores banknotes conveyed by the conveyance section 13 one note at a time, and feeds out and passes banknotes to the conveyance section 13 one note at a time. Note that the temporary holding section 15 is capable of internally storing up to around 200 banknotes.

Each banknote storage box 16 stacks and stores multiple banknotes internally. For example, in a pay-in transaction, the banknote storage boxes 16 take in and internally store banknotes conveyed by the conveyance section 13. In a pay-out transaction, the banknote storage boxes 16 separate and feed out stored banknotes one note at a time, and pass the banknotes to the conveyance section 13 in sequence.

The reject box 17 stores banknotes (referred to as reject banknotes) with a high level of damage that the classification section 14 has classified as unsuitable for re-use. The forgotten banknote storage box 18 stores banknotes that a user has forgotten to take from the pay-in/pay-out section 12. The counterfeit note storage box 19 stores banknotes that have been determined to be counterfeited (namely counterfeit notes) based on classification results of the classification section 14.

Next, explanation follows regarding banknote pay-in processing in the banknote pay-in/pay-out device 10. For example, the main controller 9 of the ATM 1 instructs the banknote controller 11 of the banknote pay-in/pay-out device 10 to start pay-in processing on receipt of an operation instruction to start a pay-in transaction from a user using the display section 6 (FIG. 1). In response, the banknote controller 11 starts the pay-in transaction.

When the user inserts banknotes into the pay-in/pay-out section 12, the banknote controller 11 uses the pay-in/pay-out section 12 to separate and take in banknotes one note at a time, and passes the banknotes to the conveyance section 13 in sequence. The conveyance section 13 conveys the banknotes to the classification section 14 with their long edges respectively bringing up the front and rear, namely with their short edges aligned with the direction of progress.

The classification section 14 notifies the banknote controller 11 of the detection results of the respective sensors as banknotes are conveyed through the inside. Based on the classification results obtained from the classification section 14, the banknote controller 11 determines the denomination and authenticity, as well as the level of damage, of each banknote, and decides the conveyance destination of each banknote based on these determination results. More specifically, the banknote controller 11 uses the conveyance section 13 to convey banknotes classified as normal banknotes to be transacted to the temporary holding section 15 to be stored. Reject banknotes classified as not for transaction are conveyed to the pay-in/pay-out section 12 by the conveyance section 13 and given back to the user.

Finally, when all of the banknotes inserted into the pay-in/pay-out section 12 have been taken in, the banknote controller 11 calculates a pay-in amount based on the classification results obtained from the classification section 14, displays this on the display section 6 (FIG. 1) so as to be presented to the user, and asks the user whether or not to continue with the pay-in transaction. When an instruction to continue with the pay-in transaction is received from the user, the banknote controller 11 uses the conveyance section 13 to convey the banknotes being held in the temporary holding section 15 to the classification section 14 to be classified by denomination and level of damage, for example, and acquires the classification results.

The banknote controller 11 then controls the conveyance section 13 to convey banknotes with a low level of damage to the banknote storage boxes 16 to be stored as banknotes that are suitable for re-use, after being sorted by denomination by the conveyance section 13. However, the banknote controller 11 conveys banknotes with a high level of damage to the reject box 17 to be stored as reject banknotes that are unsuitable for re-use. The banknote controller 11 conveys banknotes determined to be counterfeit (namely counterfeit notes) to be stored in the counterfeit note storage box 19.

When the banknote controller 11 receives an instruction not to continue the pay-in transaction from the user, all of the banknotes held in the temporary holding section 15 are fed out in sequence, and conveyed in sequence to the pay-in/pay-out section 12 by the conveyance section 13 and given back to the user. When all of the banknotes have been stored in the receptacle 12A, the banknote controller 11 opens the shutter 12B to allow the user to remove the banknotes.

Next, explanation follows regarding banknote pay-out processing in the banknote pay-in/pay-out device 10. The main controller 9 of the ATM 1 instructs the banknote controller 11 of the banknote pay-in/pay-out device 10 to start pay-out processing on receipt of an operation instruction to start a pay-out transaction from a user using the display section 6 (FIG. 1). The banknote controller 11 first decides the denominations and numbers of notes corresponding to the pay-out amount, and then feeds out banknotes in sequence from the banknote storage boxes 16 in these denominations and numbers to be conveyed by the conveyance section 13 to the classification section 14 for classification.

When this is performed, the banknote controller 11 conveys banknotes with conveyance state issues, such as overlapping conveyance in which plural banknotes are conveyed overlapping with each other, to the reject box 17 as reject banknotes, and conveys normal banknotes corresponding to the pay-out amount to the pay-in/pay-out section 12, and allows the user to remove the banknotes. In cases in which a specific duration has elapsed without the user removing the paid out banknotes, the banknote controller 11 considers the banknotes to have been forgotten, and the banknotes are taken back in and stored in the forgotten banknote storage box 18.

Accordingly, when reject banknotes arise, the banknote pay-in/pay-out device 10 uses the conveyance section 13 to convey them to the reject box 17 to be stored.

1-2. Reject Box Configuration

Figure 3:
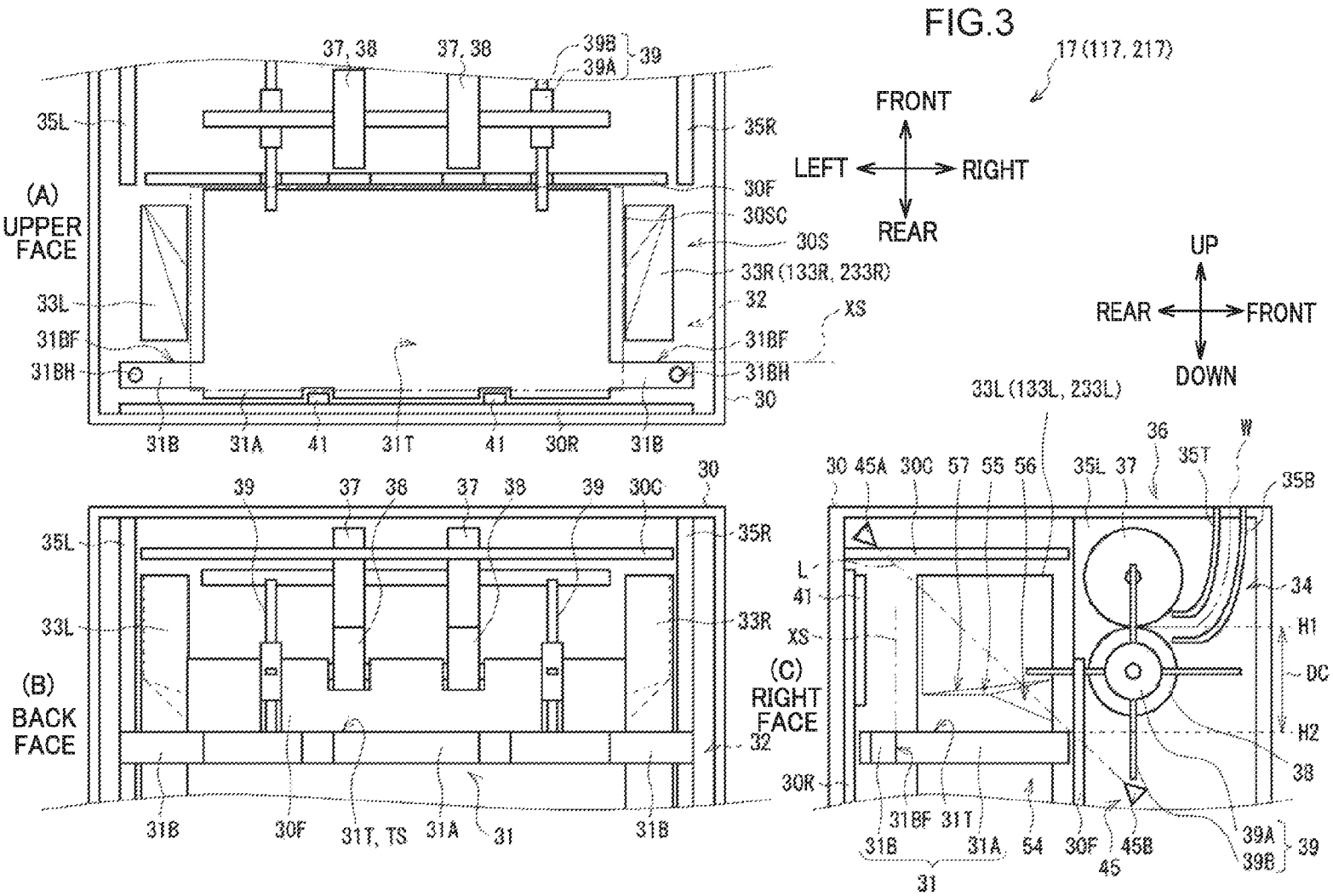
FIG. 3 are schematic drawings illustrating a reject box.

As illustrated schematically in three planes in (A) top left, (B) bottom left, and (C) bottom right of FIG. 3, the reject box 17 stores banknotes BL, serving as a medium, inside a rectangular block shaped casing 30. Note that in FIG. 3, for ease of explanation, some components are depicted see-through, or are omitted.

Front, rear, left, right, upper, and lower side faces of the casing 30 are substantially closed off, protecting the stacked banknotes and the respective components inside from the exterior. A rectangular box shaped internal space 30S is formed inside the casing 30, and a plate shaped front side plate 30F, a rear side plate 30R, and a top plate 30C are provided inside the casing 30.

A stage 31, on an upper face 31T of which banknotes BL are placed, is provided inside the internal space 30S. The stage 31 is formed with a substantially horizontally disposed plate face, and includes a rectangular shaped main placement portion 31A at the center, and stage arms 31B at the left and right. Plural banknotes BL are stacked along an upward direction, this being a stacking direction, in the main placement portion 31A by placing the banknotes BL sequentially on an upper face 31T, serving as a placement face.

The stage arms 31B are formed in angular column shapes or rectangular block shapes that are long and thin along the left-right direction, and are attached at locations toward the rear of both left and right side faces of the main placement portion 31A. Upper faces of the stage arms 31B are in the same plane as the upper face of the main placement portion 31A. The upper face 31T of the stage 31 includes the upper faces of the stage arms 31B and the upper face of the main placement portion 31A.

Circular insertion holes 31BH are respectively formed penetrating the vicinity of both left and right ends of the stage arms 31B along the up-down direction. Long and thin circular column shaped stage shafts that run along the up-down direction are attached in the vicinity of both left and right ends of the internal space 30S of the casing 30, and the stage shafts are inserted through the respective insertion holes 31BH of the stage arms 31B.

Stage moving sections 32 including motors, gears, belts, and the like are provided at the outside on both the left and the right of the internal space 30S of the casing 30. The motors of the stage moving sections 32 are driven under the control of the banknote controller 11, and the resulting force in a rotation direction is converted into force along the up-down direction, and transmitted to the vicinity of both left and right ends of the stage arms 31B (namely, in the vicinity of the insertion holes 31BH). The stage moving sections 32 thereby move the overall stage 31 along the stage shafts in the up-down direction, and stop the overall stage 31 at a desired height (namely, position in the up-down direction).

In the following explanation, for ease of explanation, an uppermost stacking face TS refers to either the upper face 31T of the stage 31 when banknotes BL have not been placed on the stage 31, or to the uppermost face of the banknotes BL that have been stacked on the stage 31. An imaginary extension plane XS is defined as an imaginary extension plane of a front face 31BF of the stage arms 31B.

A conveyance section 34 that conveys the banknotes BL is provided at a portion toward the top of a front side of the internal space 30S. The conveyance section 34 includes plural conveyance guides 35 and plural conveyance rollers. The conveyance guides 35 include an upper conveyance guide 35T that guides a rear side and upper side of the banknotes BL, a lower conveyance guide 35B that guides a front side and lower side of the banknotes BL, a left conveyance guide 35L that guides a left side of the banknotes BL, and a right conveyance guide 35R that guides a right side of the banknotes BL. Each of the conveyance guides 35 is fixed to the casing 30.

The respective conveyance rollers of the conveyance section 34 are rotated under the control of the banknote controller 11, and the banknotes BL are guided by the conveyance guides 35 so as to convey the banknotes BL along a conveyance path W from the vicinity of a front end of an upper face of the casing 30 toward the vicinity of a front side upper end of the internal space 30S. When this is performed, the conveyance section 34 conveys the banknotes BL inside a space enclosed by the conveyance guides 35. Accordingly, the positions of the left edges and the right edges of the conveyed banknotes BL are restricted by the left conveyance guide 35L and the right conveyance guide 35R, and are further to the inside (namely toward the left-right direction center) than the inside faces.

A discharge section 36 including a combination of plural rollers and conveyance guides is provided at a portion on the opposite side of side guides 33 to the stage arms 31B, toward the front of an upper side of the casing 30 (FIG. 3), namely at a portion in the vicinity of a rear end of the conveyance section 34. The discharge section 36 receives banknotes BL from the conveyance section 13 through a conveyance mechanism inside the reject box 17, and discharges the banknotes BL into the internal space 30S.

More specifically, the discharge section 36 includes discharge rollers 37 and 38 that face each other from above and below the banknote conveyance path. The discharge rollers 37 and 38 are each formed in circular column shapes. For ease of explanation, in the following explanation, as viewed along the left-right direction, a point where the banknote BL is gripped by the discharge rollers 37 and 38 of the discharge section 36 is referred to as the discharge point 36C, and the height of the discharge point 36C is referred to as the discharge height H1 ((C) of FIG. 3).

The discharge rollers 37 and 38 are each inserted onto a center shaft running in the left-right direction, and are provided one each on either side of a specific spacing. The center shafts rotate as one with the respective rollers under drive force transmitted through motors, gears, and the like.

Respective tongue piece rollers 39, each including plural tongue pieces, are provided at the outside of both the left and right discharge rollers 38 on the lower side. Each of the tongue piece rollers 39 includes a central portion 39A formed in a circular column shape with a relatively small radius, and plural tongue pieces 39B formed long and thin in directions radiating outward from the central portion 39A.

The tongue pieces 39B are configured from an elastic material, and have an increased coefficient of friction at the surface.

Two bill stoppers 41 are provided with a specific left-right spacing between each other above a rear side face of the internal space 30S of the casing 30, namely in the vicinity of an upper end of an inner face of the rear side plate 30R of the internal space 30S. The bill stoppers 41 are formed in small rectangular block shapes, and are attached to the rear side plate 30R through elastic bodies.

An uppermost face detection section 45 is provided inside the reject box 17. The uppermost face detection section 45 includes a light emitting portion 45A that emits a detection light L, and a light receiving portion 45B that receives the detection light L. The light emitting portion 45A is attached at an upper side portion of the casing 30, and emits the detection light L obliquely downward toward the front. The light receiving portion 45B is attached at a front side portion of the casing 30, and receives the detection light L arriving obliquely from the upper rear.

In the uppermost face detection section 45, the light receiving portion 45B receives the detection light L when the uppermost stacking face TS (namely either the upper face 31T of the stage 31 or the uppermost face of the banknotes BL stacked on the stage 31) is at a position lower than a specific stacking height H2. However, in the uppermost face detection section 45, the light receiving portion 45B does not receive the detection light L when the uppermost placement face is at a position higher than the stacking height H2. A distance in the up-down direction from the discharge height H1 to the stacking height H2 in the discharge section 36 is a specific stacking spacing DC. The stacking height H2 is set at a height well-suited to stacking the banknotes BL.

The light receiving portion 45B generates an uppermost face detection signal indicating whether or not the detection light L has been received, and supplies the uppermost face detection signal to the banknote controller 11 (FIG. 2). In response to being supplied with the uppermost face detection signal, the banknote controller 11 identifies whether or not the uppermost stacking face TS is higher than the stacking height H2 based on the uppermost face detection signal, and controls the stage moving sections 32 to move the stage 31 in the up-down direction, or to stop the stage 31 (described in detail later).

In addition to this configuration, a left side guide 33L and a right side guide 33R are respectively provided on both left and right sides of the main placement portion 31A of the stage 31, namely in front of the respective stage arms 31B, in the vicinity of left and right end portions inside the internal space 30S. The left side guide 33L and the right side guide 33R have left-right symmetry to each other. Accordingly, explanation follows regarding the left side guide 33L as an example. In the following explanation, the left side guide 33L and the right side guide 33R are also collectively referred to as the side guides 33.

Figure 4:
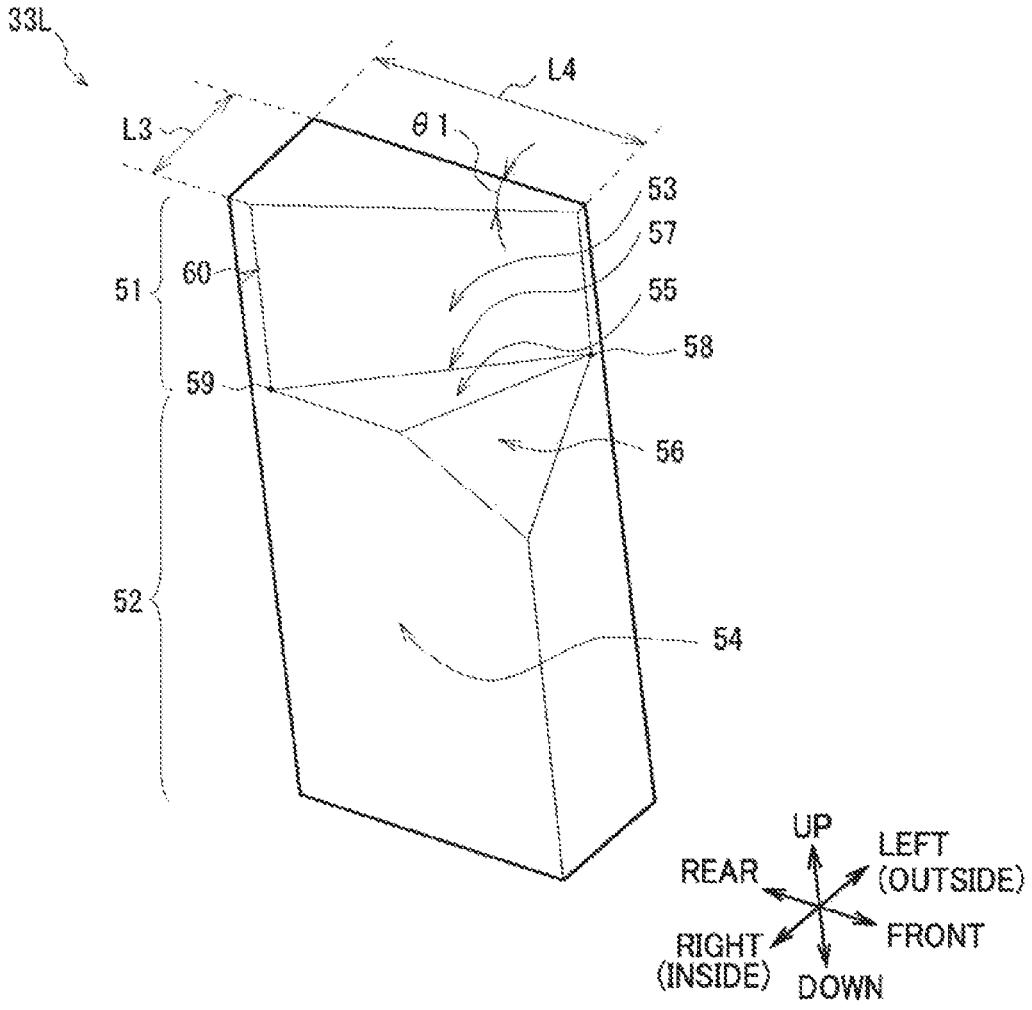
FIG. 4 is a perspective view illustrating configuration of a left side guide according to a first exemplary embodiment.
Figure 5:
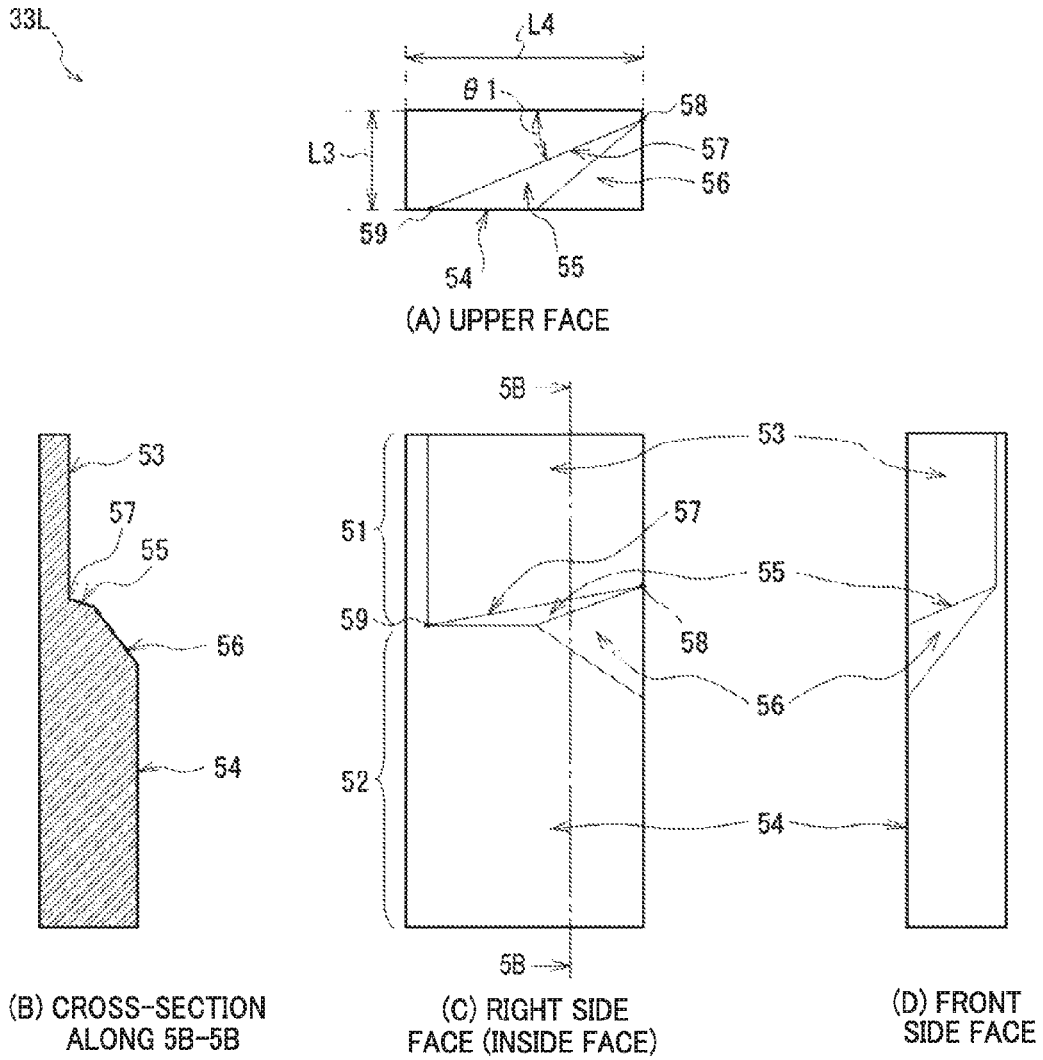
FIG. 5 are schematic drawings illustrating configuration of a left side guide according to the first exemplary embodiment.

As illustrated in perspective view in FIG. 4, and in 2-dimensional views from various directions in FIG. 5, overall, the left side guide 33L is formed in a rectangular block shape that is long in the up-down direction and relatively thin in the left-right direction.

Figure 27:
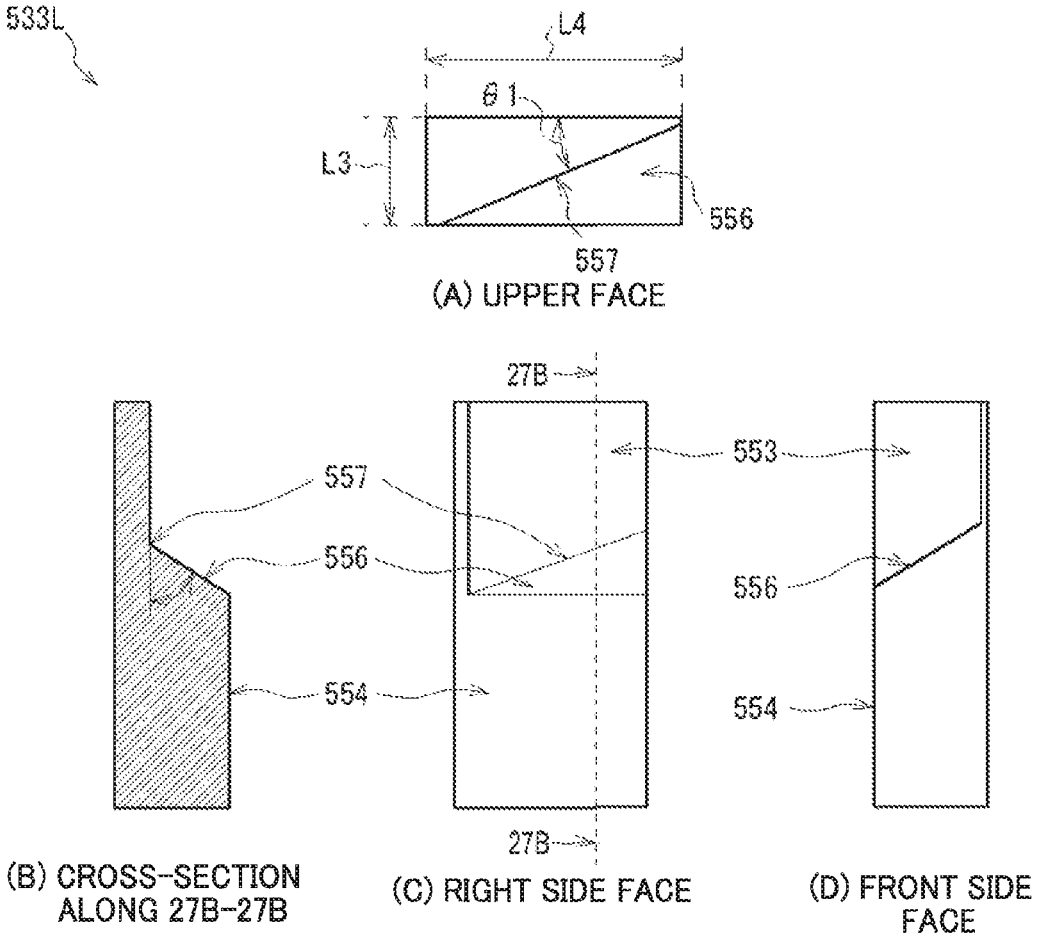
FIG.27 RELATED ART
FIG. 27 are schematic drawings illustrating configuration of a left side guide of related technology.

Similarly to the left side guide 573L of related technology (FIG. 28), the left side guide 33L has a length in the left-right direction accommodating a relatively long banknote BL. Namely, the lengths of the left side guide 33L in the left-right direction and the front-rear direction are respective lengths L3 and L4, similarly to in the left side guide 573L of related technology, these being shorter than the respective lengths L1 and L2 of the left side guide 533L of related technology (for example, FIG. 27). Accordingly, a certain gap is formed between the left side guide 33L and the stage 31, similarly to in the left side guide 573L of related technology.

The left side guide 33L is provided in the vicinity of a left end inside the internal space 30S. Accordingly, a left side and a right side of the left side guide 33L are respectively on the outside and the inside as viewed from the centers of the main placement portion 31A of the stage 31 and a stacking space 30SC ((A) of FIG. 3).

The left side guide 33L includes an upper portion 51 at an upper side and a lower portion 52 at a lower side. The upper portion 51 has a triangular column shape from which approximately the front right side half has been cut away to leave the rear left side. A discharge guide face 53 of the upper portion 51 faces toward the front right side. The discharge guide face 53 is at the angle θ1 with respect to the front-rear direction, this being the direction of progress of the banknotes BL, similarly to the discharge guide face 553 of the side guide 533 of related technology (for example, FIG. 27).

The lower portion 52 has a rectangular block shape overall, and a stacking guide face 54 of the lower portion 52 faces toward the right side. In the lower portion 52, two flat faces, namely a support guide face 55 and an inclined slide face 56, are formed in the vicinity of an adjoining portion to the upper portion 51.

Although the support guide face 55 is relatively close to horizontal, the support guide face 55 is inclined so as to be lower at a rear side than at a front side, and lower at a right side than at a left side. A guiding valley portion 57, this being an adjoining portion between the support guide face 55 and the discharge guide face 53, is recessed further toward the lower left direction than its surroundings, and has a valley shape or groove shape, as can be seen in (B) and (C) of FIG. 5. For ease of explanation, in the following explanation an end point at a front side and an end point at a rear side of the guiding valley portion 57 are respectively referred to as the valley portion front end point 58 and the valley portion rear end point 59.

The inclined slide face 56, serving as a guiding inclined face, is positioned between the support guide face 55 and the stacking guide face 54 in a range of approximately the rear side half of the left side guide 33L. The angle of inclination of the inclined slide face 56 with respect to a horizontal plane is larger than the angle of inclination of the support guide face 55, and the inclined slide face 56 is inclined so as to be lower at a front side than at a rear side, and lower at a right side than at a left side.

Figure 6:
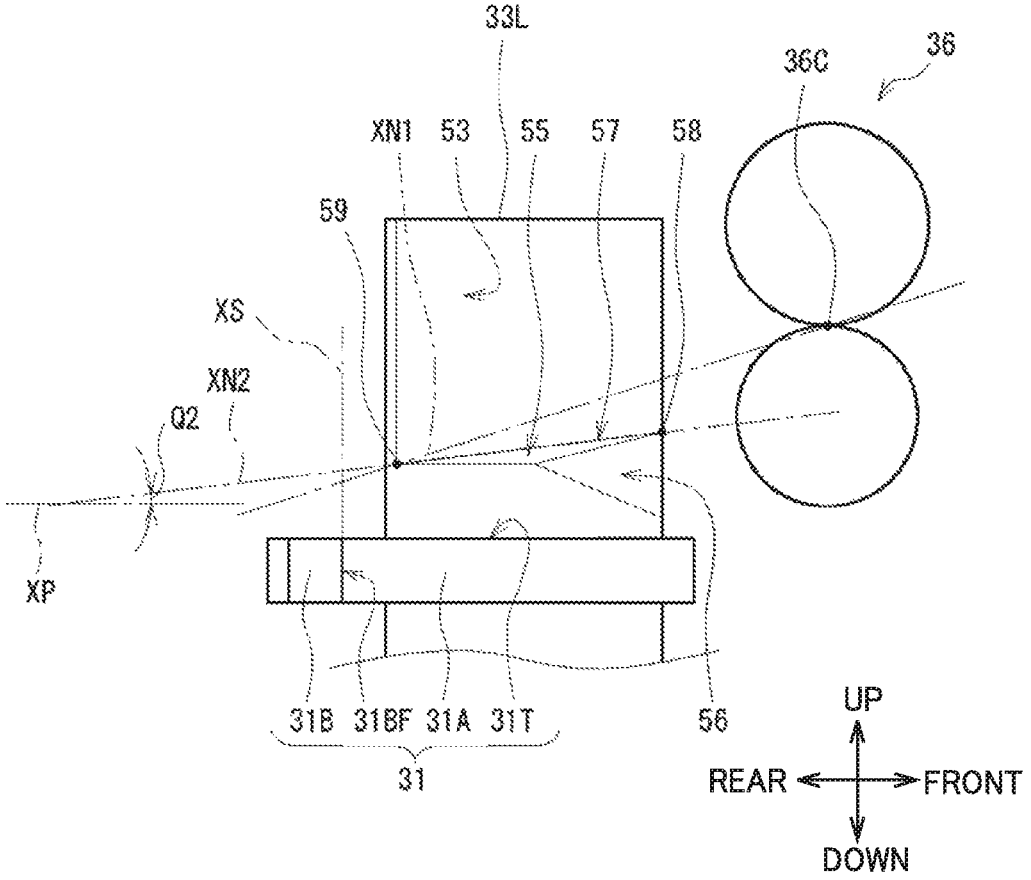
FIG. 6 is a schematic drawing illustrating configuration of a left side guide according to the first exemplary embodiment.

As illustrated in FIG. 6 that is an enlargement of part of (C) of FIG. 3, for ease of explanation, in the following explanation, an imaginary extension line XN1 is defined as an imaginary straight line connecting the discharge point 36C of the discharge section 36 and the valley portion rear end point 59 of the left side guide 33L, and an extension line thereof. An imaginary extension line XN2 is defined as an imaginary straight line extending the guiding valley portion 57 toward the rear. An imaginary direction of progress line XP refers to an imaginary straight line running along the front-rear direction (namely the horizontal direction), this being the banknote direction of progress.

An angle θ2 between the imaginary extension line XN2 and the imaginary direction of progress line XP is an angle of inclination at which a banknote BL can be guided toward the rear direction. In the left side guide 33L, the valley portion rear end point 59, this being the end point on the rear side of the guiding valley portion 57, is set at a relatively high position. Accordingly, in the left side guide 33L, both the imaginary extension lines XN1 and XN2 intersect the imaginary extension plane XS at a position sufficiently higher than the upper face 31T of the stage 31.

Moreover, in the left side guide 33L, the height of the valley portion front end point 58, this being the end point on the front side of the guiding valley portion 57, is set lower than the discharge point 36C of the discharge section 36. Accordingly, in the left side guide 33L, the height at which banknotes BL are discharged from the discharge section 36 is amply contained within the up-down range of the discharge guide face 53. Accordingly, if a banknote BL is offset in the left-right direction, a vertex and edge of the banknote BL contact and slide against the discharge guide face 53.

In the left side guide 33L, the height of the valley portion rear end point 59 is set lower than the valley portion front end point 58. Accordingly, in the left side guide 33L, the discharge guide face 53 and the guiding valley portion 57 are set higher at the front side and lower at a rear side. Namely, the angle of the imaginary extension line XN2 with respect to the imaginary direction of progress line XP is the angle θ2.

In the following explanation, in the internal space 30S, a rectangular box shaped space bordered at the top and bottom by the top plate 30C and the upper face 31T of the stage 31, bordered at the front and rear by the front side plate 30F and the rear side plate 30R, and bordered at the left and right by the stacking guide faces 54 of the left side guide 33L and the right side guide 33R, is referred of the as the stacking space 30SC ((A) of FIG. 3). The stacking space 30SC is a space within the internal space 30S that is demarcated by the stage 31, the left side guide 33L, the right side guide 33R, and the like, and is a space in which the banknotes BL are stacked.

Accordingly, in the reject box 17, the side guides 33 are provided at positions separated by a certain gap toward the outside at both the left and right of the main placement portion 31A of the stage 31.

1-3. Reject Box Banknote Storage Operation

Next, explanation follows regarding basic storage operations of banknotes BL by the reject box 17, respectively covering a normal case, a case in which a banknote BL is offset in the left-right direction, and a case in which the short edges of a banknote BL are at an angle with respect to the direction of progress.

1-3-1. Normal Case

In a normal case, the banknote controller 11 (FIG. 2) uses the stage moving sections 32 (FIG. 3) to move the stage 31 upward while monitoring the uppermost face detection signals from the uppermost face detection section 45, and pauses the stage 31 when an OFF level uppermost face detection signal has been acquired from the uppermost face detection section 45. When this occurs, in the reject box 17, the detection light L of the uppermost face detection section 45 is being blocked by either a banknote BL or the stage 31, meaning that the uppermost stacking face TS is at a position higher than the stacking height H2.

Next, the banknote controller 11 uses the stage moving sections 32 to move the stage 31 gradually downward, while continuing to monitor the uppermost face detection signals, and stops the stage 31 and maintains it at that height at the point that the uppermost face detection signal changes to ON. As illustrated in (C) of FIG. 3, the reject box 17 accordingly adjusts the up-down distance from the discharge height H1 to the uppermost stacking face TS to the stacking spacing DC, with the height of the uppermost stacking face TS as the stacking height H2. Note that the following explanation assumes that there are no banknotes BL stacked on the stage 31, and the uppermost stacking face TS is the upper face 31T of the stage 31.

Figure 7:
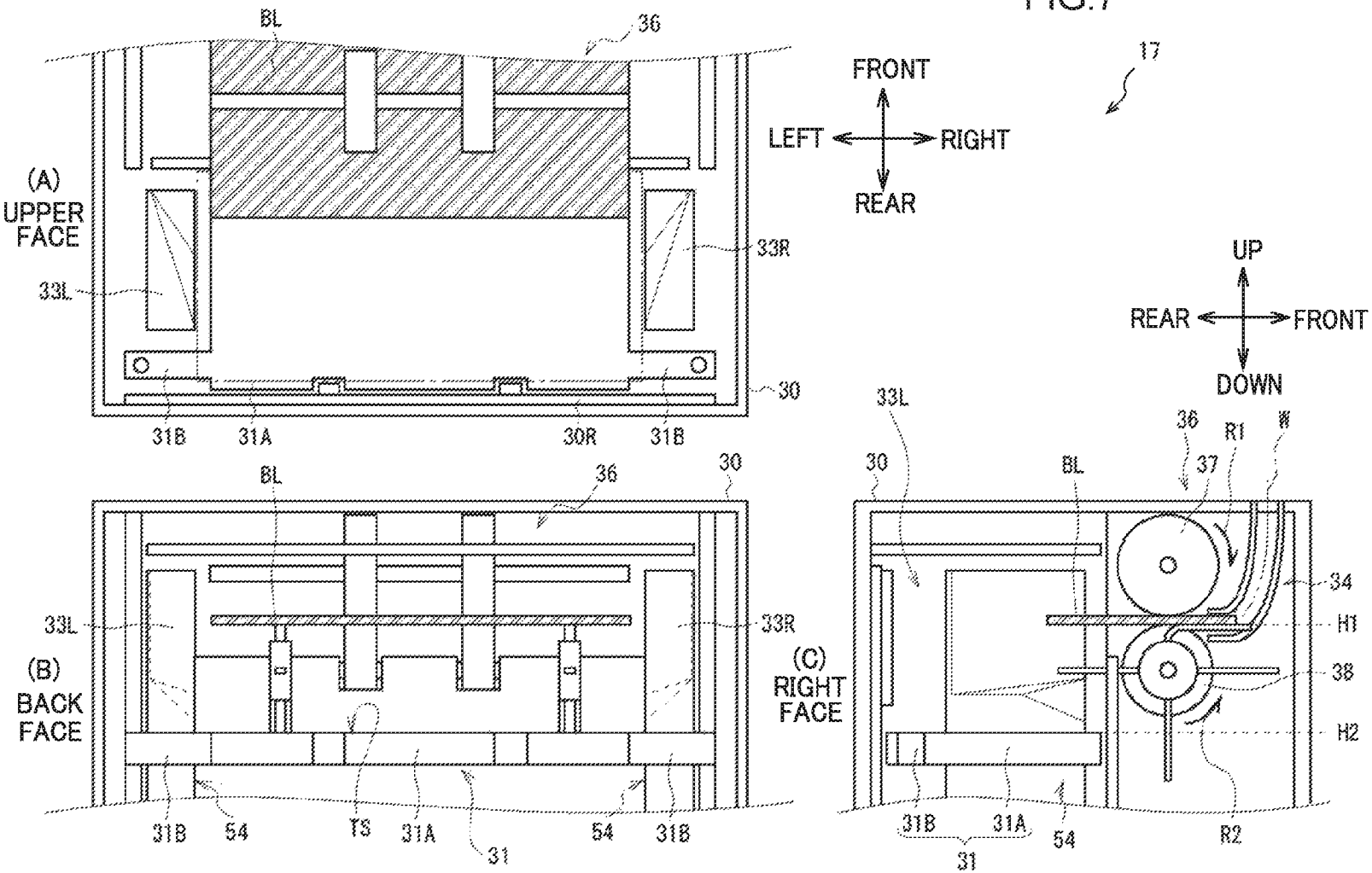
FIG. 7 are schematic drawings illustrating banknote storage in a reject box (1).

When a banknote BL is passed from the conveyance section 13 (FIG. 2), the reject box 17 conveys the banknote BL along the conveyance path W using the conveyance section 34, and, as illustrated in FIG. 7 corresponding to FIG. 3, grips the banknote BL from above and below with the discharge rollers 37 and 38 of the discharge section 36. Note that both left and right edges of the banknote BL (namely the short edges on both the left and right sides) are positioned further to the inside than the respective stacking guide faces 54 of the left side guide 33L and the right side guide 33R.

Under the control of the banknote controller 11, discharge section 36 rotates the discharge rollers 37 in the arrow R1 direction, and rotates the discharge rollers 38 in the opposite arrow R2 direction, thereby discharging the banknote BL into the internal space 30S to the rear from the discharge height H1.

Figure 8:
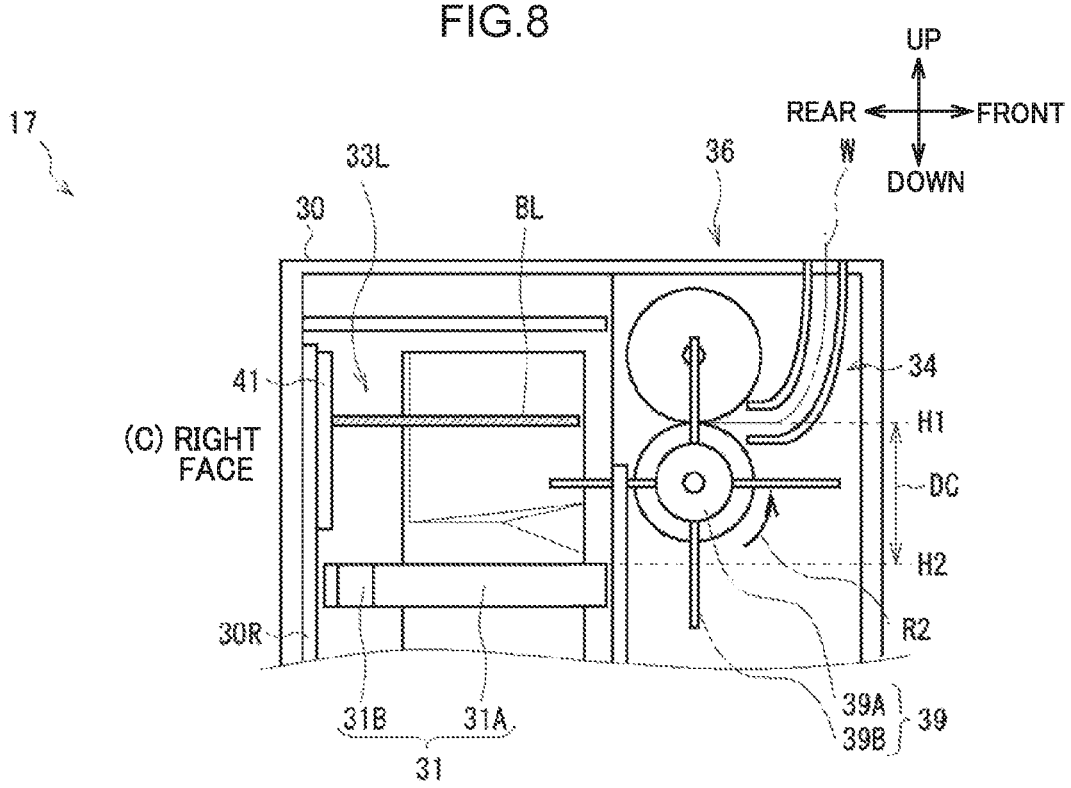
FIG. 8 is a schematic drawing illustrating banknote storage in a reject box (2).

The banknote BL discharged from the discharge section 36 progresses toward the rear inside the internal space 30S, and as illustrated in FIG. 8 corresponding to (C) of FIG. 7, the banknote BL strikes the bill stoppers 41. The bill stoppers 41 elastically deform the elastic bodies, thereby absorbing the impact of being struck by the banknote BL, and the elastic bodies return to their original shapes so as to push the banknote BL back slightly toward the front.

Figure 9:
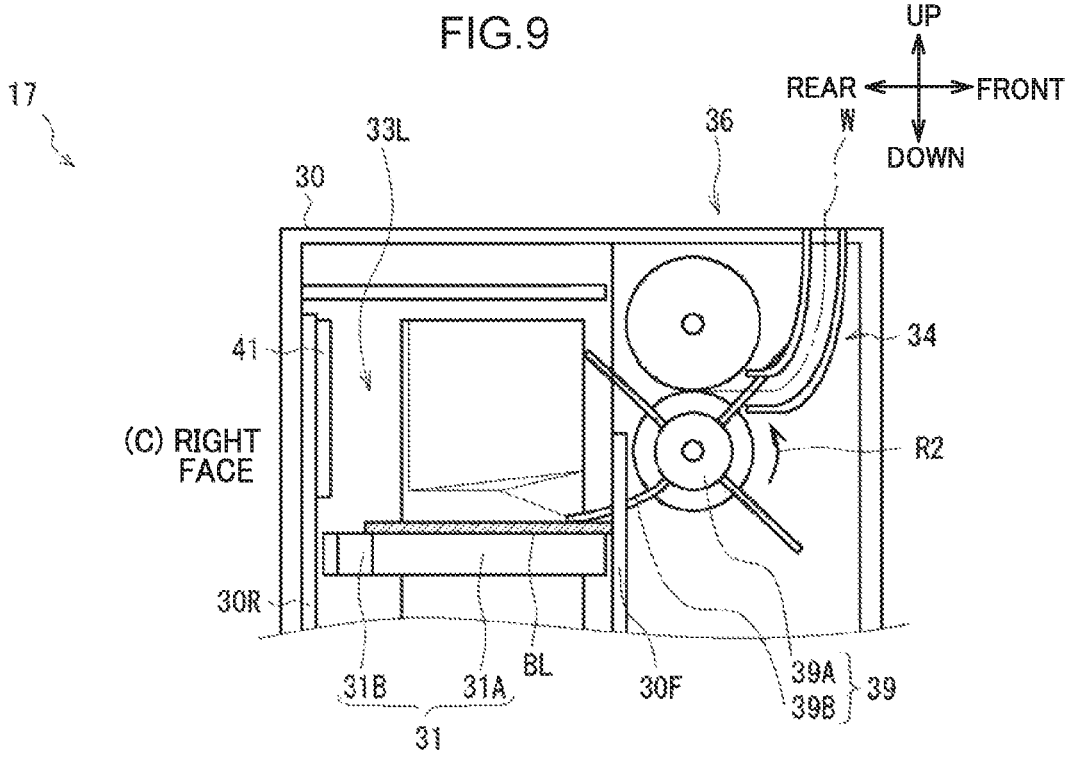
FIG. 9 is a schematic drawing illustrating banknote storage in a reject box (3).

The tongue piece rollers 39 rotate in the arrow R2 direction, similarly to the discharge rollers 38. Accordingly, as illustrated in FIG. 9, the tongue pieces 39B of the tongue piece rollers 39 tap the banknote BL inside the casing 30 onto the uppermost stacking face TS, namely onto the upper face 31T of the stage 31, and also drag the banknote BL back toward the front.

As a result, the banknote BL is stacked on the stage 31 in a state substantially parallel to the upper face 31T of the stage 31 with the sheet face spread open in a flat plane shape, at a position surrounded from the left and right by the respective stacking guide faces 54 of the left side guide 33L and right side guide 33R, and with the long edge on a front side of the banknote BL abutting the front side plate 30F. Namely, the banknote BL is stacked neatly in an appropriate state and at an appropriate position in the stacking space 30SC.

The banknote controller 11 continuously monitors the uppermost face detection signals from the uppermost face detection section 45. When the uppermost stacking face TS exceeds the stacking height H2 due to the stacked banknotes BL, the detection light L (FIG. 3) is blocked, such that an OFF level uppermost face detection signal is acquired from the uppermost face detection section 45. When this occurs, the banknote controller 11 controls the stage moving sections 32 to lower the stage 31 by a specific movement amount, thereby bringing down the uppermost stacking face TS to a position a certain amount lower than the stacking height H2. The banknote controller 11 thereby maintains the distance from the discharge height H1 to the uppermost stacking face TS inside the reject box 17 at substantially the stacking spacing DC ((C) of FIG. 3).

In this manner, the reject box 17 discharges banknotes BL into the internal space 30S from the discharge section 36, causes the banknotes BL to strike the bill stoppers 41, and taps the banknotes BL with the tongue pieces 39B of the tongue piece rollers 39 so as to stack the banknotes BL neatly on the stage 31.

1-3-2. Case in which Banknote is Offset in Left-Right Direction

Next, explanation follows regarding a storage operation of a banknote BL in in a case in which the position of the banknote BL is offset in the left-right direction. First, similarly to in the normal case above, the reject box 17 adjusts the height of the uppermost stacking face TS to the stacking height H2 under the control of the banknote controller 11. The reject box 17 gradually receives banknotes BL conveyed by the conveyance section 34 into the discharge section 36.

Figure 10:
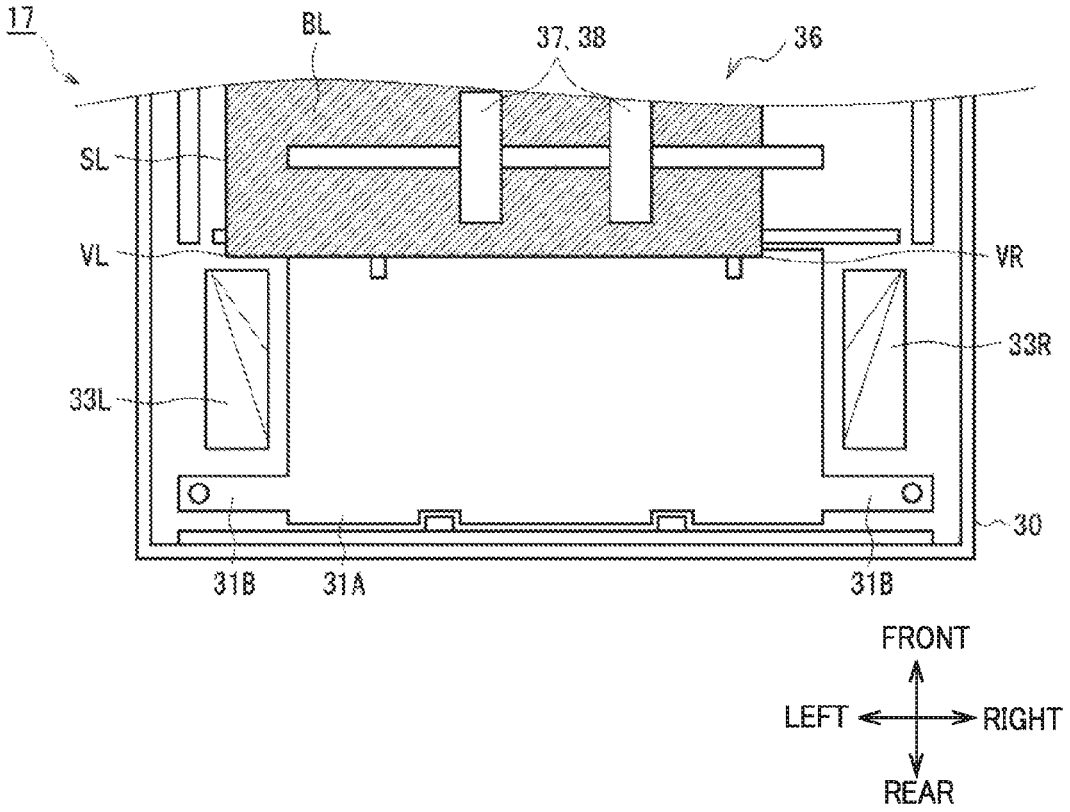
FIG. 10 is a schematic drawing illustrating banknote storage in a reject box (4).

Suppose that as illustrated in FIG. 10 corresponding to (A) of FIG. 7, a banknote BL is heavily offset toward the left side at the point that it is received into the discharge section 36 from the conveyance section 34. When this occurs, due to the action of gravity, the vicinity of an end portion at the rear side of the banknote BL, this being the front side in the direction of progress, sags down slightly more than a portion on the front side where the banknote BL is gripped by the discharge section 36.

Figure 11:
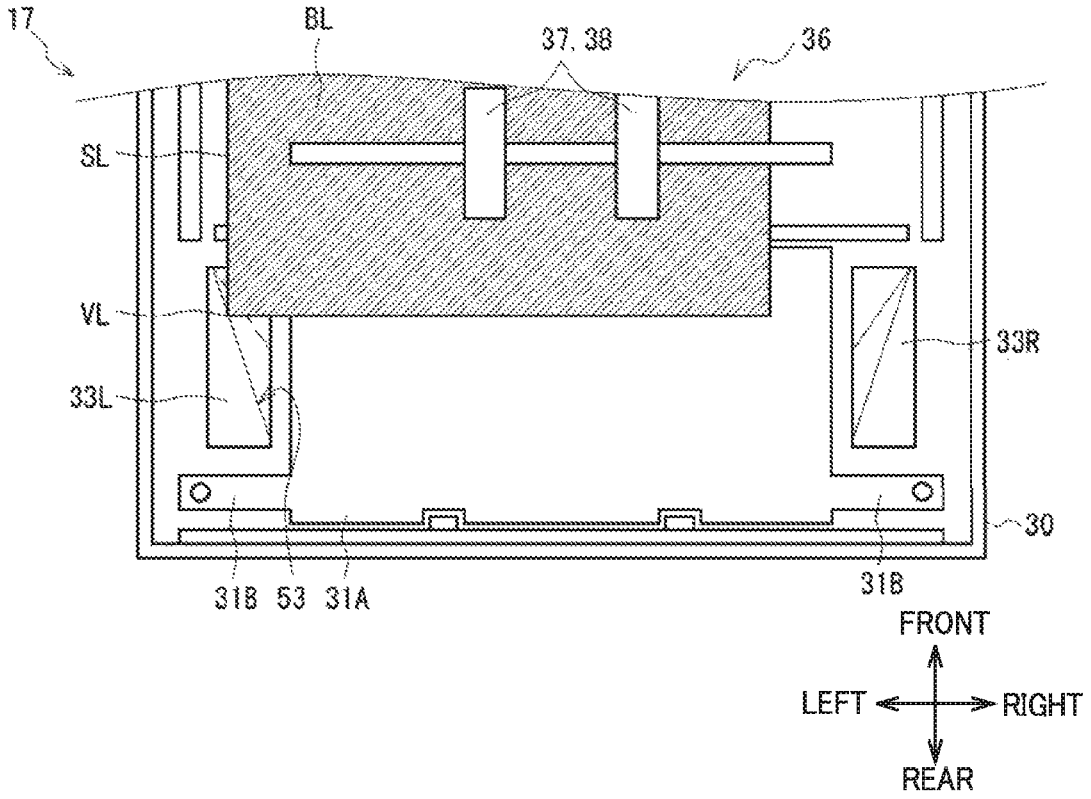
FIG. 11 is a schematic drawing illustrating banknote storage in a reject box (5).

Similarly to in the normal case, the reject box 17 rotates the discharge rollers 37 and 38 of the discharge section 36 while gripping the banknote BL from above and below with the discharge rollers 37 and 38, thereby moving the banknote BL toward the rear, and gradually passing the banknote BL into the internal space 30S. Accordingly, as illustrated in FIG. 11, a vertex (referred to below as the left rear vertex VL) on the left side of a rear edge portion of the banknote BL, this being in the lead in the direction of progress, contacts the discharge guide face 53 of the left side guide 33L.

The reject box 17 then rotates the discharge rollers 37 and 38 of the discharge section 36 further, moving the banknote BL further toward the rear. When this occurs, although the banknote BL encounters resistance toward the right direction from the discharge guide face 53 through the left rear vertex VL, banknote BL does not move toward the right direction due to being gripped by the discharge rollers 37 and 38. Instead, a rear left portion of the banknote BL flexes, while the left rear vertex VL of the banknote BL slides downward toward the rear along the discharge guide face 53.

Figure 12:
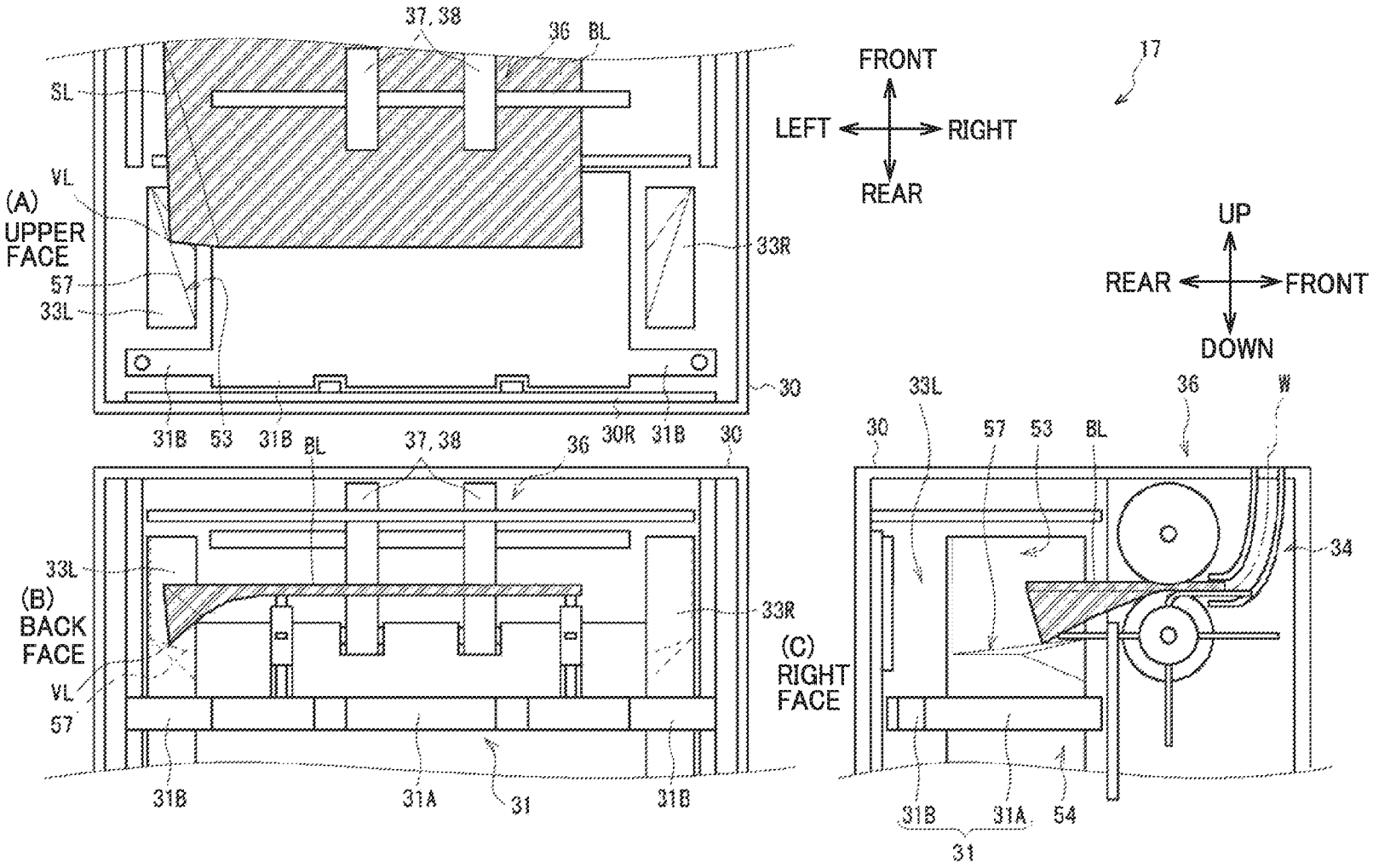
FIG. 12 are schematic drawings illustrating banknote storage in a reject box (6).

The reject box 17 continues to rotate the discharge rollers 37 and 38 of the discharge section 36, such that the left rear vertex VL of the banknote BL reaches the guiding valley portion 57, as illustrated in FIG. 12. When this occurs, since the guiding valley portion 57 has a shape recessed in a downward direction toward the left (namely a valley shape or groove shape), the left rear vertex VL moves along the guiding valley portion 57 in an oblique downward direction toward the right and the rear, without slipping over the support guide face 55 in a downward direction toward the right.

Figure 13:
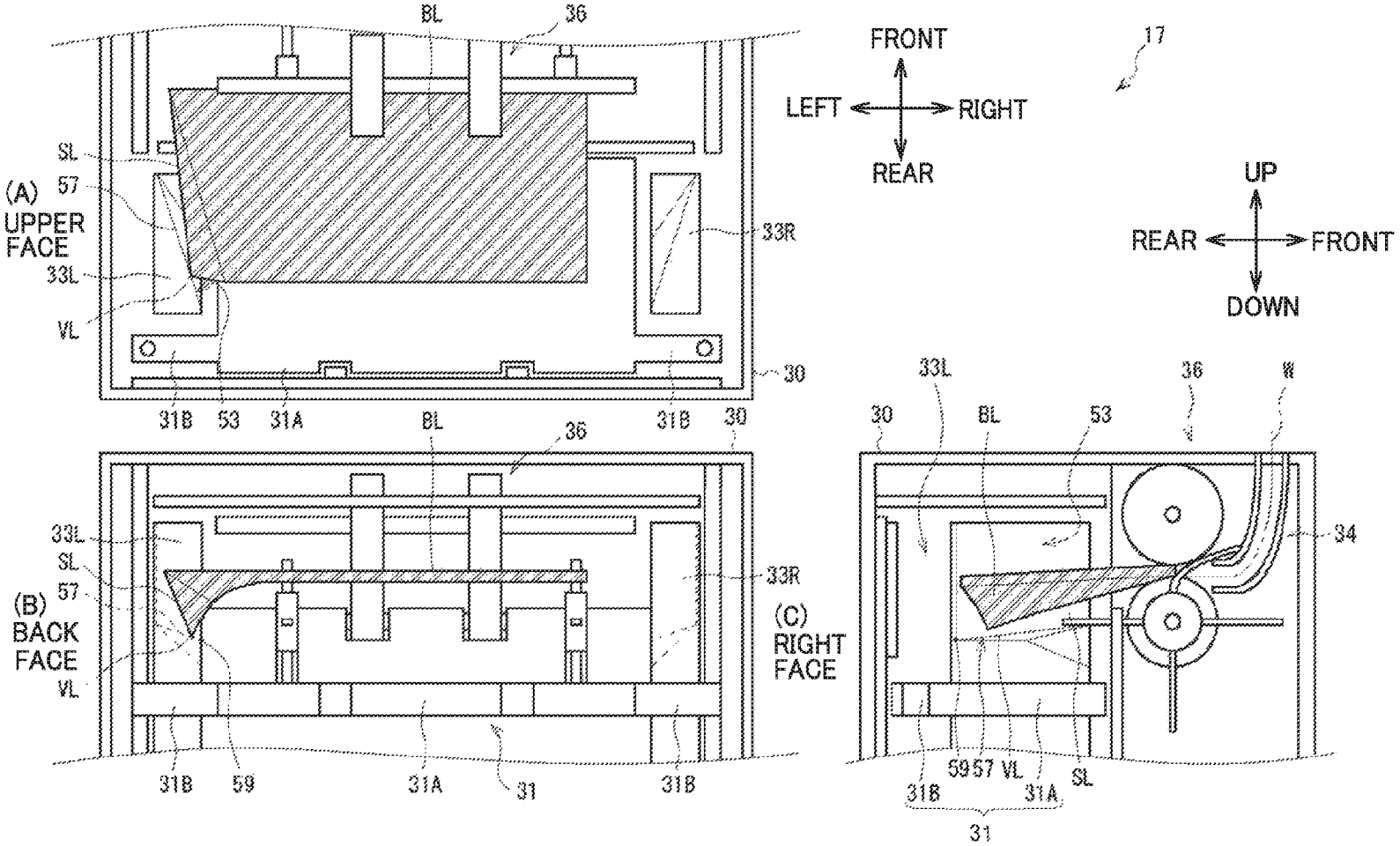
FIG. 13 are schematic drawings illustrating banknote storage in a reject box (7).

Finally, the reject box 17 continues to rotate the discharge rollers 37 and 38 of the discharge section 36, thereby discharging a front side edge portion of the banknote BL, this being the following side in the direction of progress, into the internal space 30S, as illustrated in FIG. 13.

When this occurs, the gripping of the banknote BL by the discharge section 36 is released, causing elastic force to act such that a force acts to return the bent portion at the left rear side of the banknote BL to a flat plane shape. Note that since the left rear vertex VL of the banknote BL slides along (contacts) the guiding valley portion 57, the banknote BL is supported by the guiding valley portion 57 through the left rear vertex VL, and the overall banknote BL moves gradually toward the right direction, supported at a point at the left rear vertex VL. Namely, the offset of the banknote BL toward the left direction is gradually corrected by the action of elastic force as the banknote BL progresses toward the rear, in a state in which the left rear vertex VL is supported by the guiding valley portion 57 from the left side (namely the outside) and the lower side (namely the side where the stage 31 is present).

Figure 14:
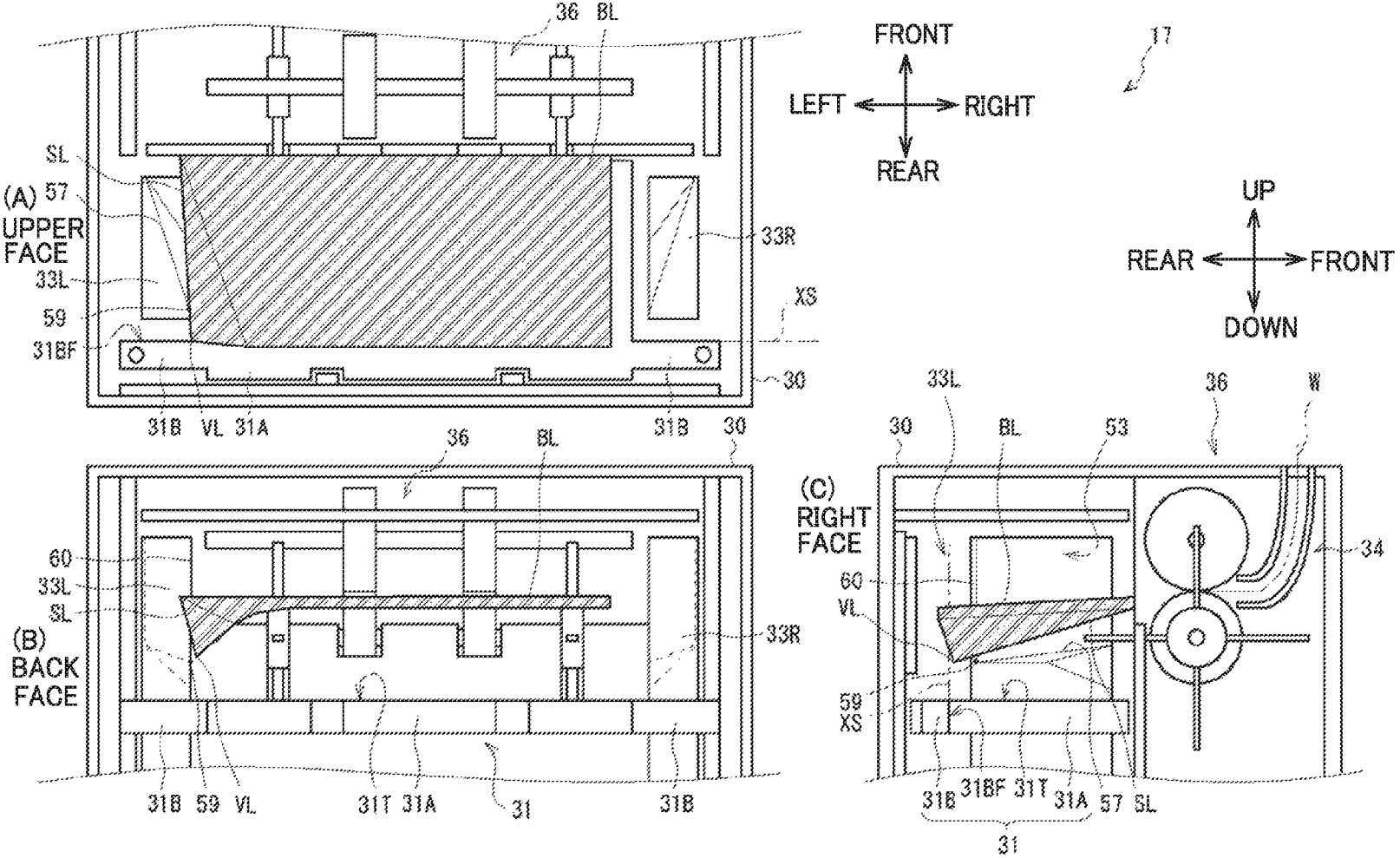
FIG. 14 are schematic drawings illustrating banknote storage in a reject box (8).

The banknote BL then progresses toward the rear inside the internal space 30S under the impetus of being discharged from the discharge section 36, and as illustrated in FIG. 14, the left rear vertex VL reaches the imaginary extension plane XS, this being an imaginary extension plane of the front face 31BF of the stage arms 31B.

Since a left edge SL of the banknote BL slides along either the valley portion rear end point 59 or a ridge portion 60 formed above the valley portion rear end point 59, the left rear vertex VL is always positioned above the imaginary extension line XN1. Moreover, as described above, in the left side guide 33L, the respective heights (up-down direction positions) of the valley portion front end point 58 and the valley portion rear end point 59 are set such that the imaginary extension line XN1 (FIG. 6) intersects the imaginary extension plane XS further to the upper side than the upper face 31T of the stage 31.

Accordingly, when the left rear vertex VL of the banknote BL reaches the imaginary extension plane XS, the left rear vertex VL is positioned above the stage arm 31B, and progresses toward the rear without contacting the front face 31BF of the stage arm 31B.

Finally the banknote BL strikes the bill stoppers 41, similarly to in FIG. 8 and FIG. 9 illustrating the normal case, and is tapped downward by the tongue pieces 39B of the tongue piece rollers 39, before being stacked on the stage 31. By this time, the banknote BL has opened out into a substantially flat plane shape by the action of elastic force, and the sheet faces are substantially parallel to the stage 31. Moreover, the left edge SL is in a state restricted by the left side guide 33L. Namely, the banknote BL is stacked on the stage 31 so as to be contained neatly within the stacking space 30SC ((A) of FIG. 3), in a state in which the offset toward the left direction has been corrected.

Note that in the reject box 17, supposing that the length of the short edge of a banknote BL (namely, the length in the front-rear direction) is relatively long, sometimes an edge portion on the front side (following side) of the banknote BL is discharged into the internal space 30S after the left rear vertex VL has passed the valley portion rear end point 59.

When this occurs, instead of the left rear vertex VL sliding along (contacting) the guiding valley portion 57 as in FIG. 13, the left edge SL slides along (contacts) the valley portion rear end point 59, causing a similar elastic force to act such that the overall banknote BL is moved gradually toward the right direction, supported at a point at the left rear vertex VL.

Then, when the left rear vertex VL of the banknote BL reaches the imaginary extension plane XS, the left edge SL of the banknote BL slides along the valley portion rear end point 59 or the ridge portion 60 formed above the valley portion rear end point 59. When this occurs, the left edge SL has a smaller angle of inclination with respect to the horizontal direction than the angle θ2 that is the angle of inclination of the imaginary extension line XN1 (FIG. 6), and is closer to being horizontal than the imaginary extension line XN1.

Accordingly, the left rear vertex VL of the banknote BL is always positioned further to the upper side than the imaginary extension line XN1, such that similarly to in the case illustrated in FIG. 14, the left rear vertex VL passes above the stage arm 31B and progresses toward the rear without striking the front face 31BF of the stage arm 31B. As a result, the banknote BL is ultimately stacked on the stage 31 in a state in which the offset toward the left direction has been corrected, similarly to in the normal case.

In a case in which a banknote BL is offset toward the right direction in the reject box 17, a right rear vertex VR of the banknote BL (FIG. 10) is always positioned further to the upper side than the imaginary extension line XN1 by the right side guide 33R, with left-right symmetry to the case described above.

In this manner, when a banknote BL is offset in the left-right direction, the reject box 17 uses the side guides 33 to correct the offset of the banknote. Moreover in the reject box 17, the height of the valley portion rear end points 59 is set appropriately, and the left rear vertex VL or the right rear vertex VR of the banknote BL is always positioned further to the upper side than the imaginary extension line XN1, thereby enabling the banknote BL to be prevented from striking the stage arms 31B.

1-3-3. Case in which Banknote is at an Angle

Next, explanation follows regarding a storage operation of a banknote BL in a case in which the short edges of the banknote BL are at an angle with respect to the direction of progress.

In the banknote pay-in/pay-out device 10, it is desirable for the short edges of a banknote BL to be parallel to the direction of progress in the respective sections of the conveyance section 13 and the reject box 17. However, sometimes the short edges end up at an angle with respect to the direction of progress, for example due to a banknote BL catching on a peripheral component in the conveyance section 13 or in the internal space 30S.

Suppose that in the reject box 17, such a banknote BL is discharged into the internal space 30S, strikes the bill stoppers 41, and is then tapped downward by the tongue pieces 39B of the tongue piece rollers 39 to stack the banknote BL on the uppermost stacking face TS.

Figure 15:
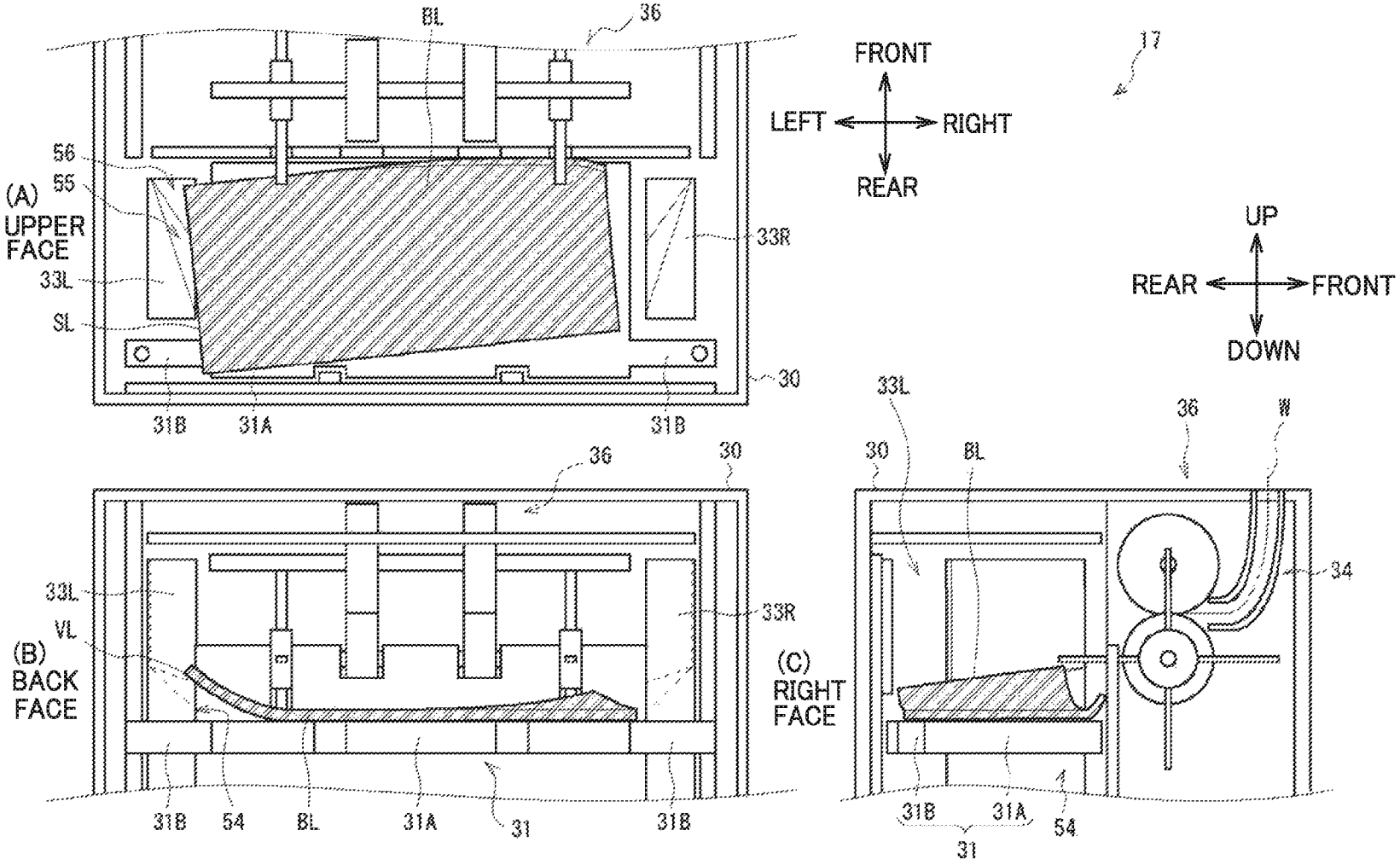
FIG. 15 are schematic drawings illustrating banknote storage in a reject box (9).

When this is performed, the banknote BL could, for example, come to rest on the support guide face 55 of the left side guide 33L at the left edge SL and the vicinity thereof, as illustrated in FIG. 15. The vicinity of the left edge SL of the banknote BL would thereby be in a state lifted up from the uppermost stacking face TS, with a portion thereof at a higher position than the support guide face 55 or an extension plane of the support guide face 55.

Supposing that a new banknote BL were to be discharged from the discharge section 36 in this state, the new banknote BL would strike the vicinity of the left edge SL of the banknote BL stacked at the uppermost side on the stage 31. In such cases, it would be difficult for the reject box 17 to discharge the new banknote BL into the internal space 30S correctly, potentially causing jams or damage to banknotes.

However, the left side guide 33L is formed with the inclined slide face 56. Accordingly, even when the left edge SL and the vicinity thereof of a banknote BL temporarily come to rest on the support guide face 55, the left side guide 33L allows the left edge SL and the vicinity thereof to slide down along the inclined slide face 56, thereby leading the left edge SL to below the support guide face 55 or an extension plane of the support guide face 55, and further to the right side than the stacking guide face 54 (namely, toward the inside).

In the left side guide 33L, a right lower edge of the inclined slide face 56 adjoins the stacking guide face 54. Accordingly, the left side guide 33L allows the left edge SL to slide down along the inclined slide face 56, such that the left edge SL slides down along the stacking guide face 54. Accompanying this, the left side guide 33L may rotate the overall banknote BL by a certain amount such that the left edge SL becomes closer to being parallel with the stacking guide face 54, so as to ultimately approach a normal stacking state.

In the reject box 17, due to providing the left side guide 33L with the inclined slide face 56, in a case in which the short edges of a banknote BL are at an angle with respect to the direction of progress, the left edge SL and the vicinity thereof are allowed to slide down along the inclined slide face 56 even if the left edge SL and the vicinity thereof come to rest on the support guide face 55.

1-4. Operation and Advantageous Effects

In the above explanation, in the reject box 17 of the banknote pay-in/pay-out device 10 of the ATM 1 according to the first exemplary embodiment, the lengths of the side guides 33 in the left-right direction and the front-rear direction are set with the relatively short lengths L3 and L4. This thereby enables the reject box 17 to extend the stacking space 30SC in the left-right direction, enabling storage of banknotes BL with long edges that are relatively long, and also forming a certain gap between the stage 31 and the side guides 33.

Each side guide 33 has a shape in which the discharge guide face 53 and the support guide face 55 adjoin each other at the guiding valley portion 57, and the valley portion rear end point 59 is set at a relatively high position, such that the imaginary extension line XN1 passes above the upper face 31T of the stage 31 (FIG. 6).

In the reject box 17, in cases in which a banknote BL received into the discharge section 36 from the conveyance section 34 is offset in the left-right direction, the banknote BL is moved toward the rear and finally discharged from the discharge section 36 while either the left rear vertex VL or the right rear vertex VR contacts the corresponding discharge guide face 53 and guiding valley portion 57 (FIG. 12 and FIG. 13). When this occurs, the banknote BL attempts to return to a flat plane shape under the action of elastic force, and moves toward the right direction supported at a point at either the left rear vertex VL or the right rear vertex VR, thus gradually eliminating the offset.

The banknote BL then moves further toward the rear under this impetus, and when this occurs, the left edge SL or the right edge SR contacts and slides along the valley portion rear end point 59 or the ridge portion 60, such that the left rear vertex VL or the right rear vertex VR passes above the stage arm 31B without striking the stage arm 31B (FIG. 13).

Figure 28:
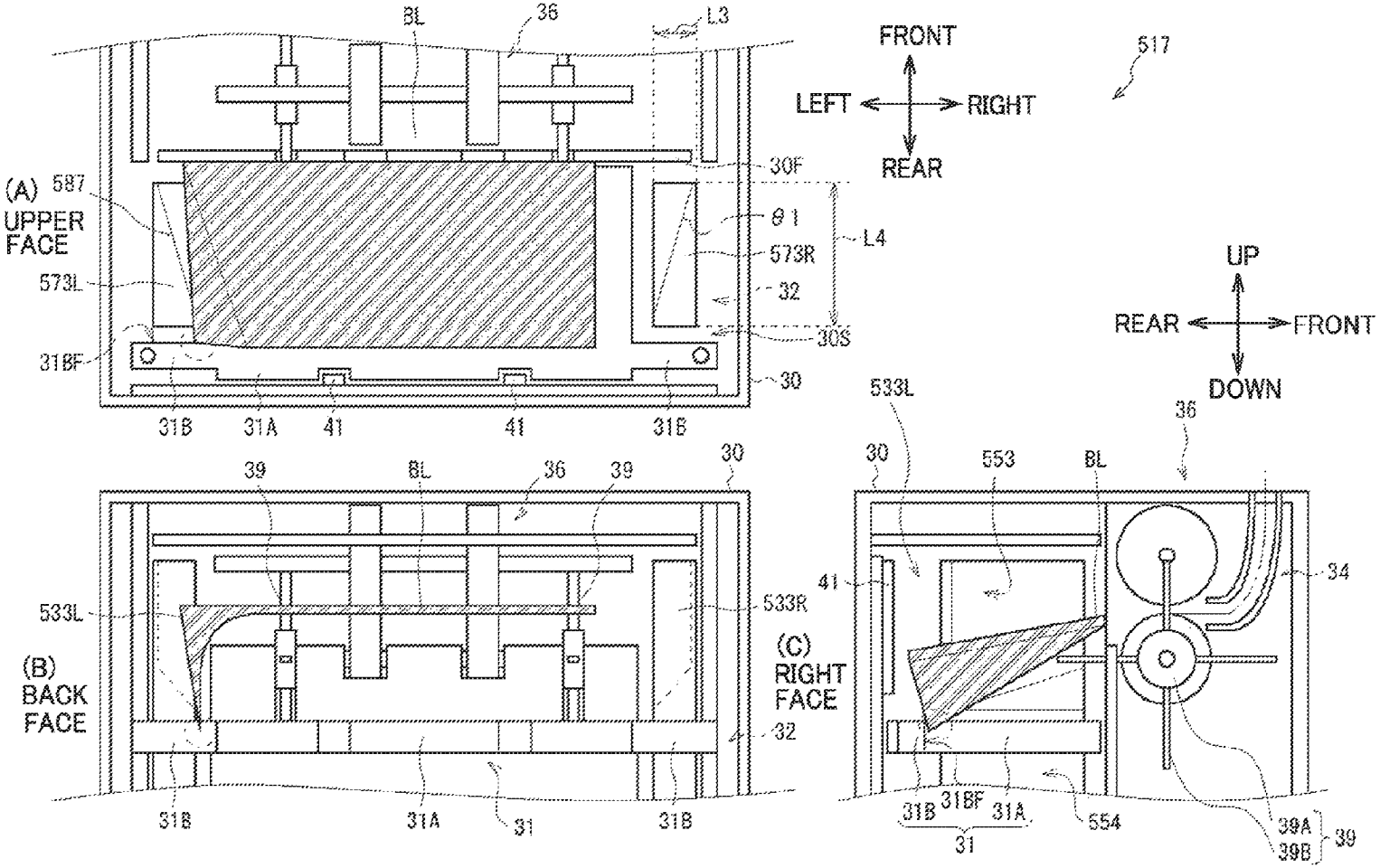
FIG.28 RELATED ART
FIG. 28 are schematic drawings illustrating banknote storage in a reject box of related technology.

The reject box 17 thereby prevents the left rear vertex VL or the right rear vertex VR of the banknote BL from being allowed to contact the stage arms 31B as illustrated in FIG. 28, as well as preventing collisions with new banknotes BL discharged after this banknote BL, thereby preventing banknote jams, damage, and the like.

When the number of banknotes BL stacked in the internal space 30S has increased and the distance from the upper face 31T of the stage 31 to the uppermost stacking face has increased, the reject box 17 moves the stage 31 downward under the control of the banknote controller 11, and maintains the uppermost stacking face TS substantially at the stacking height H2. Namely, when storing banknotes in the reject box 17, the upper face 31T of the stage 31 is not moved to a position higher than the stacking height H2, even when the number of stacked banknotes BL has increased.

Accordingly, in the reject box 17, it is sufficient that the height of the valley portion rear end point 59 in each of the side guides 33 is set such that the imaginary extension plane XS passes above the upper face 31T when the upper face 31T of the stage 31 is at the stacking height H2. The reject box 17 thereby reliably prevents the banknotes BL from striking the stage arms 31B, irrespective of the number of banknotes BL stacked on the stage 31.

The reject box 17 is moreover formed with the inclined slide faces 56 at portions toward the front inside of the support guide faces 55 of the respective side guides 33. Accordingly, for example, even when the short edges of a banknote BL are at an angle with respect to the front-rear direction, this being the direction of progress, and the left edge SL and the vicinity thereof come to rest on the support guide face 55 when the banknote BL is placed on the uppermost stacking face TS, the reject box 17 allows the left edge SL and the vicinity thereof to slide along the inclined slide face 56.

As a result, the reject box 17 stacks the banknotes BL neatly in the stacking space 30SC, such that previously stacked banknotes BL and other banknotes BL newly discharged from the discharge section 36 do not collide or obstruct stacking of the banknotes BL.

Figure 25:
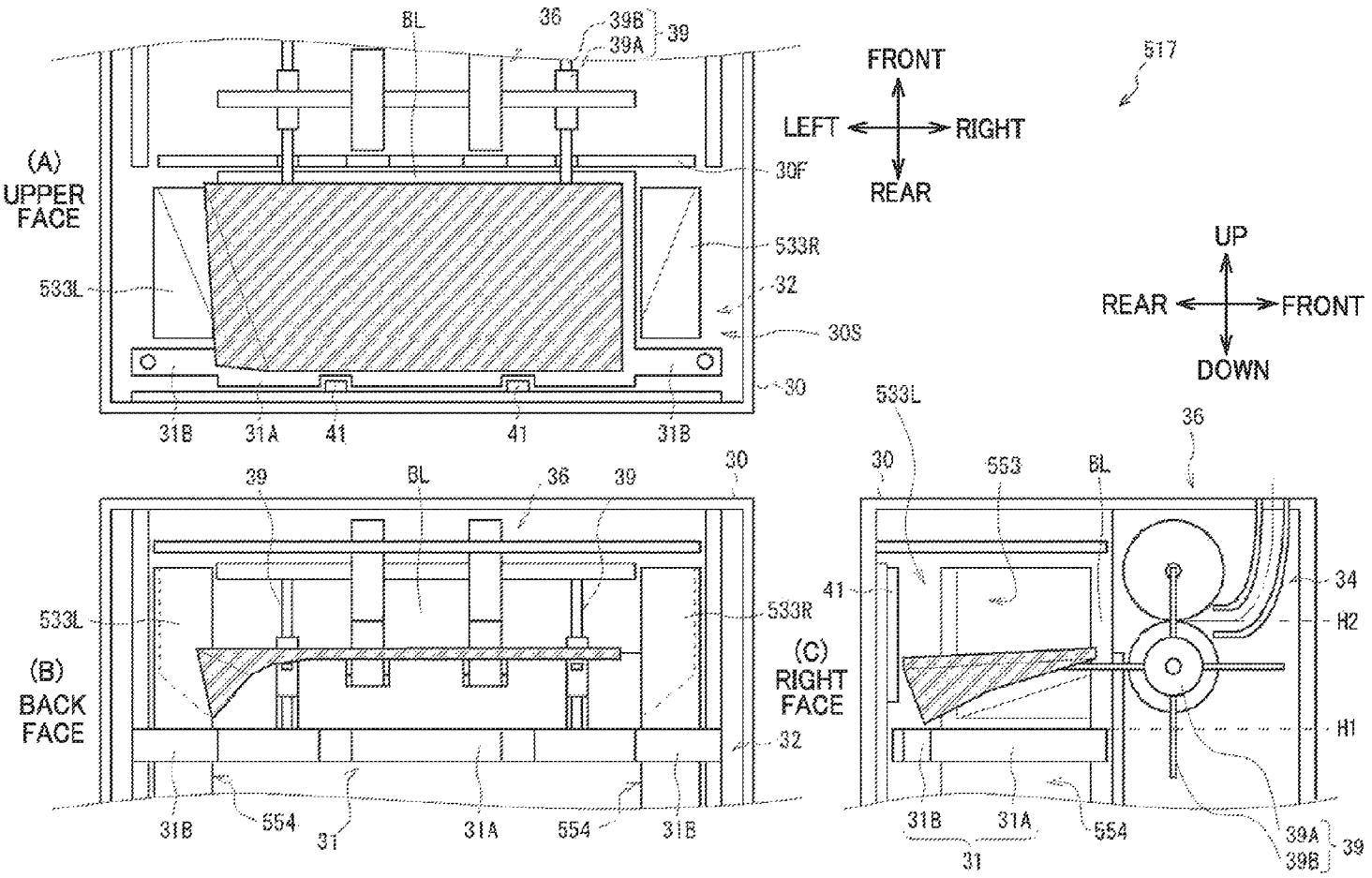
FIG.25 RELATED ART
FIG. 25 are schematic drawings illustrating configuration of a reject box of related technology.

The reject box 17 differs from the reject box 517 of related technology (FIG. 25) only in the shape of the side guides 33. The stage 31 and the like are similar. Accordingly, in the reject box 17, in cases in which the side guides 533 of related technology that form a narrow gap to the stage 31 are attached in place of the side guides 33, the banknotes BL are still guided without contacting the stage arms 31B, similarly to in the reject box 517 of related technology.

Due to the above, in the reject box 17 according to the first exemplary embodiment the valley portion rear end points 59 are set at a relatively high position in the side guides 33, such that the imaginary extension line XN1 passes above the upper face 31T of the stage 31. Accordingly, in the reject box 17, when a banknote BL discharged from the discharge section 36 is offset in the left-right direction, the left rear vertex VL or the right rear vertex VR of the banknote BL contacts the discharge guide face 53, and is then guided toward the front along the guiding valley portion 57. In the reject box 17, the left edge SL of the banknote BL then contacts or slides against the valley portion rear end point 59 or the ridge portion 60, thereby moving the banknote BL such that it does not strike the stage arms 31B, and ultimately stacking the banknote BL appropriately on the stage 31.

2. Second Exemplary Embodiment

An ATM 101 (FIG. 1) according to a second exemplary embodiment differs from the ATM 1 according to the first exemplary embodiment in the point that it includes a banknote pay-in/pay-out device 110 in place of the banknote pay-in/pay-out device 10 of the ATM 1 according to the first exemplary embodiment. The ATM 101 is similar to the ATM 1 according to the first exemplary embodiment in other respects. The banknote pay-in/pay-out device 110 (FIG. 2) differs from the banknote pay-in/pay-out device 10 in the point that it includes a reject box 117 in place of the reject box 17 of the banknote pay-in/pay-out device 10. The banknote pay-in/pay-out device 110 is similar to the banknote pay-in/pay-out device 10 in other respects.

The reject box 117 (FIG. 3) differs from the reject box 17 according to the first exemplary embodiment in the point that it includes a left side guide 133L and a right side guide 133R (referred to collectively below as the side guides 133) in place of the left side guide 33L and the right side guide 33R of the reject box 17 according to the first exemplary embodiment. The reject box 117 is similar to the reject box 17 in other respects.

Similarly to the side guides 33 (FIG. 3) of the first exemplary embodiment, the lengths of the side guides 133 in the left-right direction and the front-rear direction are set to the relatively short lengths L3 and L4, and gaps are formed between the side guides 133 and the stage 31. The left side guide 133L and the right side guide 133R are configured with left-right symmetry to each other, similarly to in the first exemplary embodiment. Accordingly, explanation follows regarding the left side guide 133L as an example.

Figure 16:
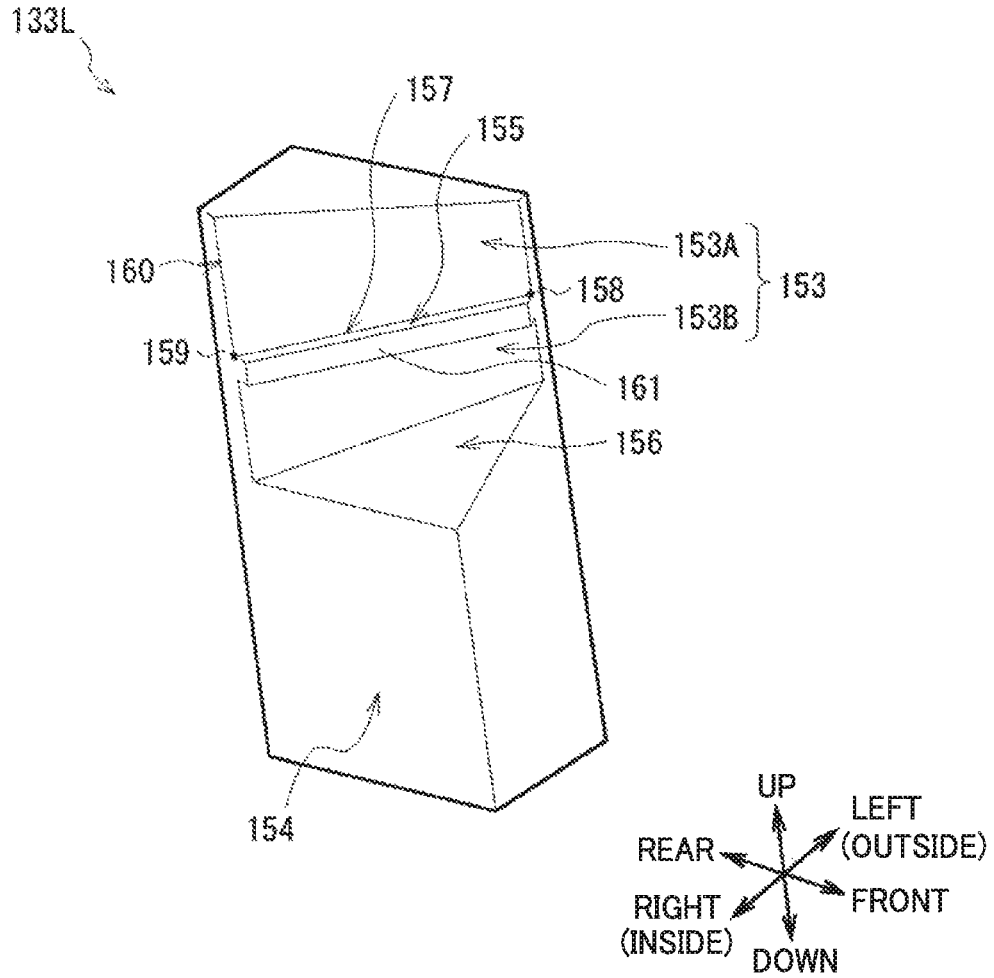
FIG. 16 is a perspective view illustrating configuration of a left side guide according to a second exemplary embodiment.
Figure 17:
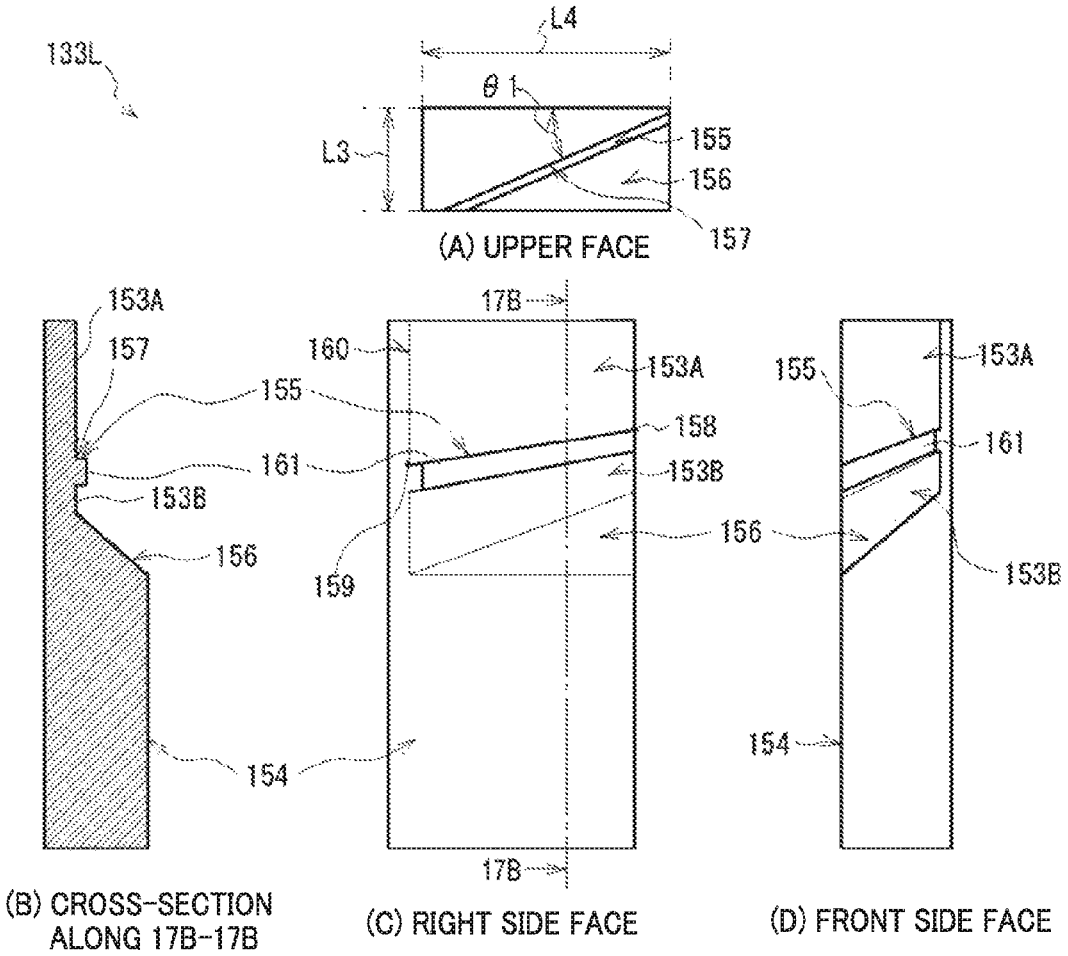
FIG. 17 are schematic drawings illustrating configuration of a left side guide according to the second exemplary embodiment.
Figure 26:
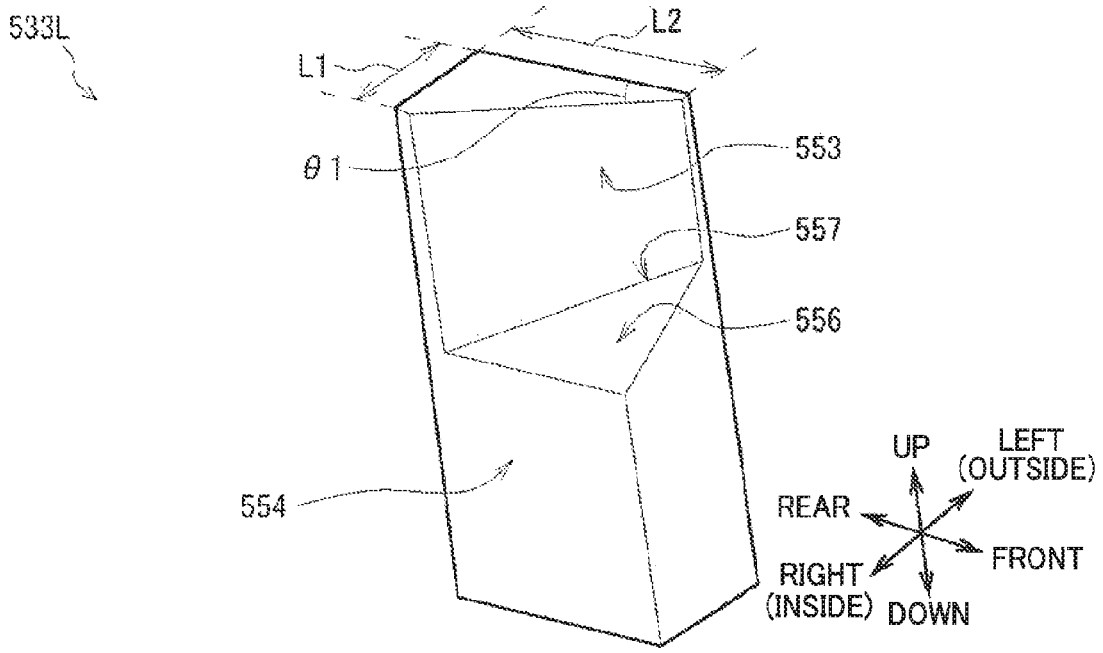
FIG.26 RELATED ART
FIG. 26 is a perspective view illustrating configuration of a left side guide of related technology.

As illustrated in FIG. 16 and FIG. 17, respectively corresponding to FIG. 4 and FIG. 5, the left side guide 133L has a configuration equivalent to one in which a rib shaped portion 161 is provided to the discharge guide face 553 of the left side guide 533L (FIG. 26 and FIG. 27) of related technology.

The rib shaped portion 161 is formed in a long, thin, angular column shape connecting between the front left and the rear right overall, and projects out in a rib shape or ridge shape from a discharge guide face 153 toward the right direction. Moreover, the rib shaped portion 161 divides the discharge guide face 153 into an upper discharge guide face 153A at the upper side and a lower discharge guide face 153B at the lower side. The discharge guide face 153 is at the angle θ1 with respect to the front-rear direction, this being the direction of progress of the banknotes BL, similarly to the discharge guide face 53 of the first exemplary embodiment.

An upper face of the rib shaped portion 161 configures a support guide face 155 corresponding to the support guide face 55 (FIG. 4 and FIG. 5) of the first exemplary embodiment. An adjoining portion between the support guide face 155 and the upper discharge guide face 153A configures a guiding valley portion 157 corresponding to the guiding valley portion 57 (FIG. 4 and FIG. 5) of the first exemplary embodiment.

An inclined slide face 156 corresponding to the inclined slide face 56 (FIG. 4 and FIG. 5) is formed between the lower discharge guide face 153B of the discharge guide face 153 and a stacking guide face 154. Namely, in the left side guide 133L, the inclined slide face 156 is positioned between the support guide face 155 and the stacking guide face 154, and the support guide face 155 and the inclined slide face 156 are not adjacent to each other, with the lower discharge guide face 153B, serving as a second discharge guide face, formed therebetween.

Front side and rear side end points of the guiding valley portion 157 are configured by a valley portion front end point 158 and a valley portion rear end point 159, corresponding to the valley portion front end point 58 and the valley portion rear end point 59 (FIG. 4 and FIG. 5) respectively. The heights (up-down direction positions) of the valley portion front end point 158 and the valley portion rear end point 159 are set so as to be equivalent to those of the valley portion front end point 58 and the valley portion rear end point 59 in the first exemplary embodiment. In addition, the positions of the upper discharge guide face 153A, the support guide face 155, and the guiding valley portion 157 are substantially the same as those of the discharge guide face 53, the support guide face 55, and the guiding valley portion 57 of the first exemplary embodiment.

Accordingly, in the reject box 117, when considering an imaginary extension line XN1 passing the valley portion rear end point 159 in place of the valley portion rear end point 59 of the first exemplary embodiment, and an imaginary extension plane XS (FIG. 6), the imaginary extension line XN1 would similarly pass above the upper face 31T of the stage 31.

In the reject box 117 in the banknote pay-in/pay-out device 110 of the ATM 101 according to the second exemplary embodiment described above, the side guides 133 are formed with the rib shaped portions 161, and the heights of the valley portion front end points 158 and the valley portion rear end points 159 are set so as to be equivalent to those of the valley portion front end points 58 and the valley portion rear end points 59 in the first exemplary embodiment.

Accordingly, in the reject box 117, in cases in which a banknote BL received into the discharge section 36 from the conveyance section 34 is offset in the left-right direction (FIG. 10), similarly to in the first exemplary embodiment, the left rear vertex VL or the right rear vertex VR of the banknote BL is moved toward the rear while contacting the corresponding upper discharge guide face 153A and guiding valley portion 157, and elastic force of the banknote BL acts so as to gradually eliminate the offset.

Then in the reject box 117, the left edge SL or the right edge SR of the banknote BL contacts and slides against the corresponding valley portion rear end point 159 or ridge portion 160, such that the left rear vertex VL or the right rear vertex VR passes above the stage arm 31B without contacting the stage arm 31B, similarly to in the first exemplary embodiment.

Namely, in the reject box 117, the upper discharge guide face 153A, the guiding valley portion 157, and the valley portion rear end point 159 respectively function in a similar way to the discharge guide face 53, the guiding valley portion 57, and the valley portion rear end point 59 of the reject box 17 according to the first exemplary embodiment, thereby preventing the banknotes BL from striking the stage arms 31B, similarly to in the first exemplary embodiment.

In the side guides 133, the projection amount of the rib shaped portions 161 from the discharge guide faces 153 is kept relatively small, and the width of the support guide faces 155 in the left-right direction is relatively narrow. The inclined slide faces 156 are formed at inside portions toward the front of the lower discharge guide faces 153B.

Accordingly, in the reject box 117, even if, for example, the short edges of a banknote BL were at an angle with respect to the front-rear direction, this being the direction of progress, and the left edge SL and the vicinity thereof were to catch (namely temporarily come to rest) on the support guide face 155 of the left side guide 133L when placed on the uppermost stacking face TS, the left edge SL and the vicinity thereof would fall down over the inclined slide face 156 due to not being stable on the narrow width in the left-right direction. Accordingly, similarly to in the first exemplary embodiment, the reject box 117 allows the left edge SL and the vicinity thereof of a banknote BL to slide down along the inclined slide face 156, thereby stacking the banknote BL neatly in the stacking space 30SC.

The reject box 117 is moreover capable of exhibiting similar operation and advantageous effects to the reject box 17 according to the first exemplary embodiment in other respects.

In the above explanation, in the reject box 117 according to the second exemplary embodiment, the rib shaped portions 161 are formed to the discharge guide faces 153 of the side guides 133, and the valley portion rear end points 159 are set at a relatively high position, such that the imaginary extension lines XN1 pass above the upper face 31T of the stage 31. Accordingly, in the reject box 117, in cases in which a banknote BL discharged from the discharge section 36 is offset in the left-right direction, similarly to in the first exemplary embodiment, the left rear vertex VL or the right rear vertex VR of the banknote BL contacts the corresponding upper discharge guide face 153A and is then guided along the guiding valley portion 157 toward the front. Then, in the reject box 117, the left edge SL of the banknote BL contacts or slides against the corresponding valley portion rear end point 159 or ridge portion 160. The banknote BL is thereby moved without striking the stage arms 31B, and ultimately stacked appropriately on the stage 31.

3. Third Exemplary Embodiment

An ATM 201 (FIG. 1) according to a third exemplary embodiment differs from the ATM 1 in the point that it includes a banknote pay-in/pay-out device 210 in place of the banknote pay-in/pay-out device 10 of the ATM 1 according to the first exemplary embodiment. Configuration is similar to the ATM 1 in other respects. The banknote pay-in/pay-out device 210 (FIG. 2) differs from the banknote pay-in/pay-out device 10 in the point that it includes a reject box 217 in place of the reject box 17 of the banknote pay-in/pay-out device 10. Configuration is similar to the banknote pay-in/pay-out device 10 in other respects.

The reject box 217 (FIG. 3) differs from the reject box 17 in the point that it includes a left side guide 233L and a right side guide 233R (referred to collectively below as the side guides 233) in place of the side guide 33 and the right side guide 33R of the reject box 17 according to the first exemplary embodiment. Configuration is similar to the reject box 17 in other respects.

Similarly to the side guides 33 (FIG. 3) of the first exemplary embodiment, the lengths of the side guides 233 in the left-right direction and the front-rear direction are set relatively short, and gaps are formed between the side guides 233 and the stage 31. The left side guide 233L and the right side guide 233R are configured with left-right symmetry to each other, similarly to in the first and second exemplary embodiments. Accordingly, explanation follows regarding the left side guide 233L as an example.

Figure 18:
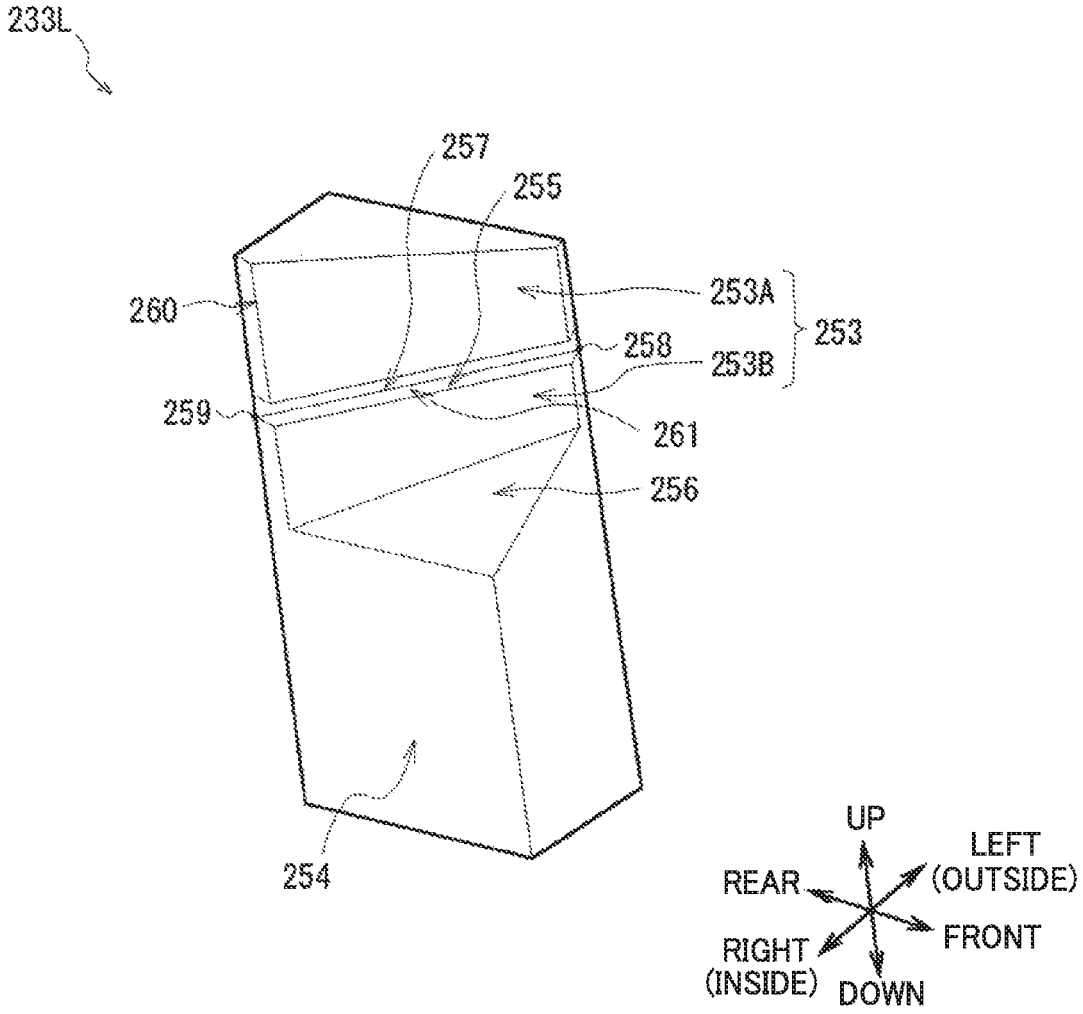
FIG. 18 is a perspective view illustrating configuration of a left side guide according to a third exemplary embodiment.
Figure 19:
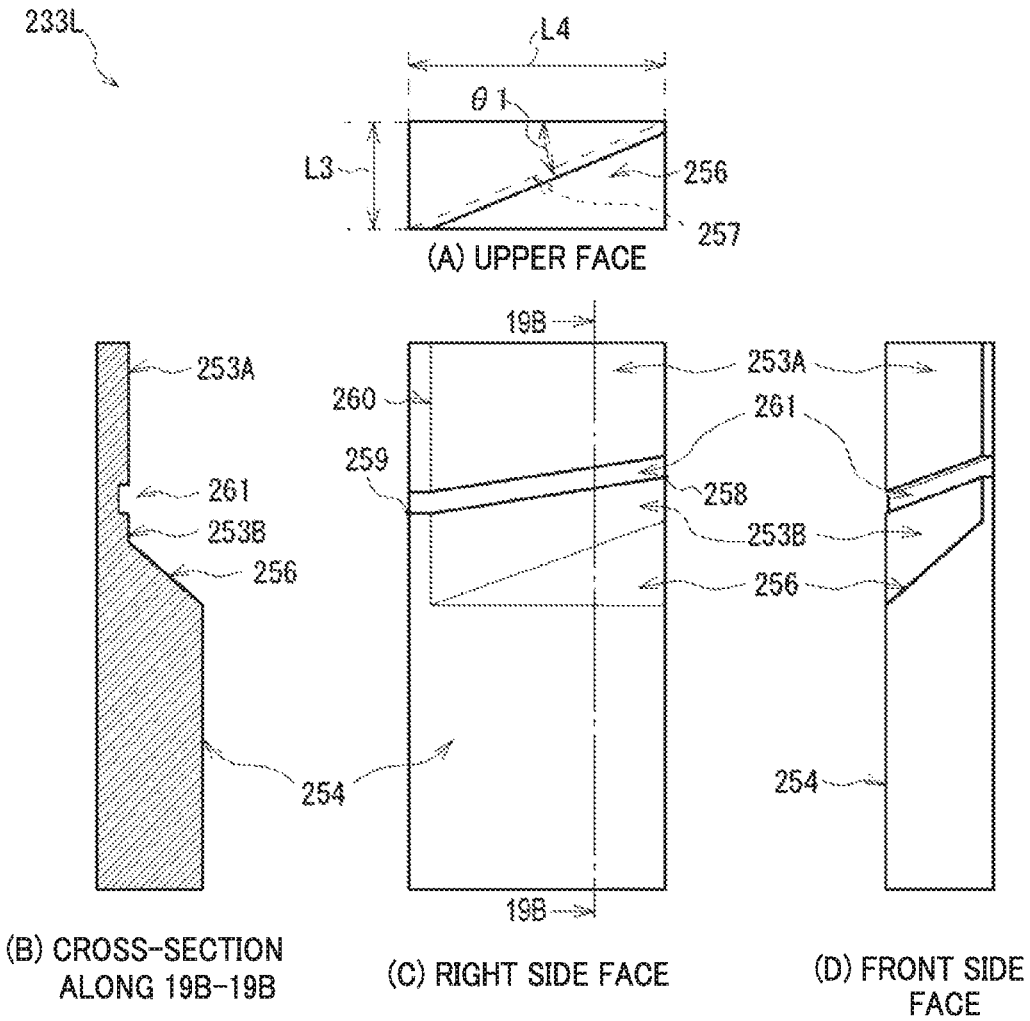
FIG. 19 are schematic drawings illustrating configuration of a left side guide according to the third exemplary embodiment.

As illustrated in FIG. 18 and FIG. 19, respectively corresponding to FIG. 4 and FIG. 5, and FIG. 16 and FIG. 17, the left side guide 233L has a configuration equivalent to one in which a groove 261 is provided in the discharge guide face 553 of the left side guide 533L (FIG. 26 and FIG. 27) of related technology. Overall, the groove 261 has a long, thin shape cutting into the vicinity of a front face of a discharge guide face 253 so as to connect between the front left and the rear right, and the groove 261 is recessed toward a front left direction from the discharge guide face 253.

The groove 261 divides the discharge guide face 253 into an upper discharge guide face 253A on the upper side and a lower discharge guide face 253B on the lower side, similarly to the discharge guide face 153 of the second exemplary embodiment (FIG. 16 and FIG. 17). The discharge guide face 253 is at the angle θ1 with respect to the front-rear direction, this being the direction of progress of the banknotes BL, similarly to the discharge guide face 53 of the first exemplary embodiment and the discharge guide face 153 of the second exemplary embodiment.

Figure 20:
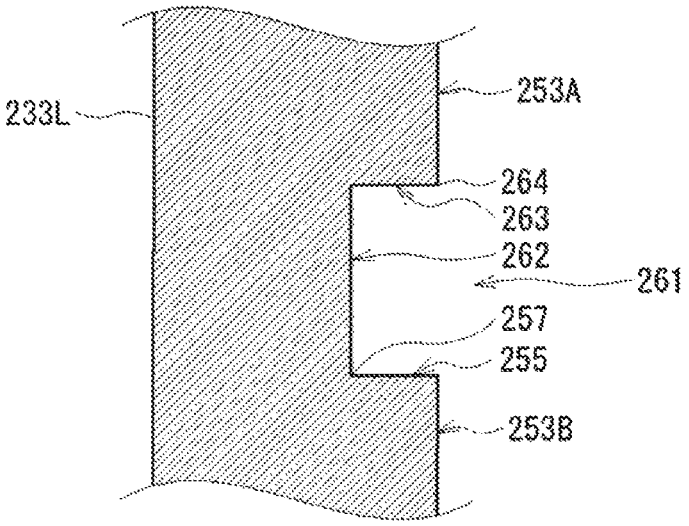
FIG. 20 is a schematic drawing illustrating configuration of a groove.

As illustrated in FIG. 20 that is an enlargement of part of (B) of FIG. 19, the groove 261 includes a support guide face 255, this being a face at the bottom, a side face 262, and a top face 263. Of these, the support guide face 255 corresponds to both the support guide face 55 according to the first exemplary embodiment (FIG. 4 and FIG. 5), and the support guide face 155 according to the second exemplary embodiment (FIG. 16 and FIG. 17).

An inclined slide face 256 similar to the inclined slide face 156 of the second exemplary embodiment (FIG. 16 and FIG. 17) is formed between the lower discharge guide face 253B of the discharge guide face 253 and a stacking guide face 254. Namely, in the left side guide 233L, similarly to in the second exemplary embodiment, the inclined slide face 256 is positioned between the support guide face 255 and the stacking guide face 254, and the support guide face 255 and the inclined slide face 256 are not adjacent, with the lower discharge guide face 253B, serving as a second discharge guide face, formed therebetween.

A guiding valley portion 257 is formed at a valley shaped portion where the support guide face 255 adjoins the side face 262. The guiding valley portion 257 corresponds to both the guiding valley portion 57 according to the first exemplary embodiment (FIG. 4 and FIG. 5) and the guiding valley portion 157 according to the second exemplary embodiment (FIG. 16 and FIG. 17). A ridge portion 264 is formed at a portion where the top face 263 adjoins the upper discharge guide face 253A.

The heights (up-down direction positions) of a valley portion front end point 258 and a valley portion rear end point 259 are set so as to be equivalent to those of the valley portion front end point 58 and the valley portion rear end point 59 in the first exemplary embodiment. Accordingly, the heights (up-down direction positions) of the support guide face 255 and the guiding valley portion 257 are substantially the same as those of the support guide face 55 and the guiding valley portion 57 in the first exemplary embodiment, and the left-right direction positions of the support guide face 255 and the guiding valley portion 257 are displaced toward the left side (namely the outside) by an amount commensurate with the depth of the groove 261.

Accordingly, in the reject box 217, when considering an imaginary extension line XN1 and an imaginary extension plane XS (FIG. 6) similarly to in the first exemplary embodiment, the imaginary extension line XN1 passes above the upper face 31T of the stage 31.

In the reject box 217 in the banknote pay-in/pay-out device 210 of the ATM 201 according to the third exemplary embodiment described above, the side guides 233 are formed with the grooves 261, and the heights of the valley portion front end points 258 and the valley portion rear end points 259 are set so as to be equivalent to those of the valley portion front end points 58 and the valley portion rear end points 59 in the first exemplary embodiment.

Figure 21A:
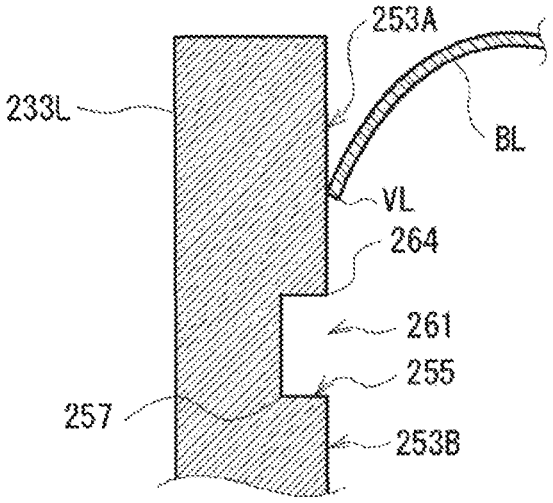
FIG. 21A is a schematic drawing illustrating support of a banknote by a groove.

Accordingly, in the reject box 217, in cases in which, for example, a banknote BL received into the discharge section 36 from the conveyance section 34 is offset toward the left direction (FIG. 10), first, as illustrated in cross-section in FIG. 21A, the left rear vertex VL of the banknote BL is moved while contacting the upper discharge guide face 253A.

Figure 21B:
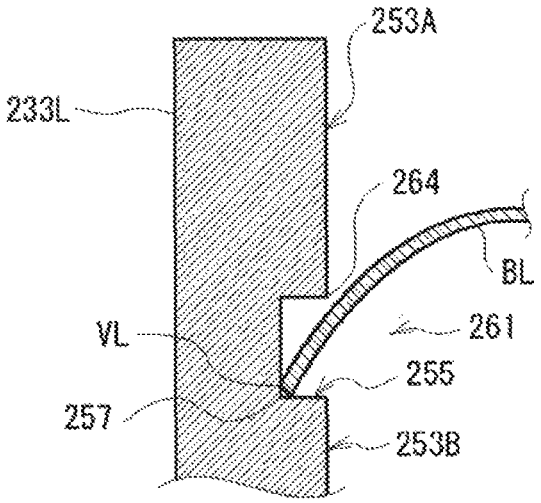
FIG. 21B is a schematic drawing illustrating support of a banknote by a groove.
Figure 21C:
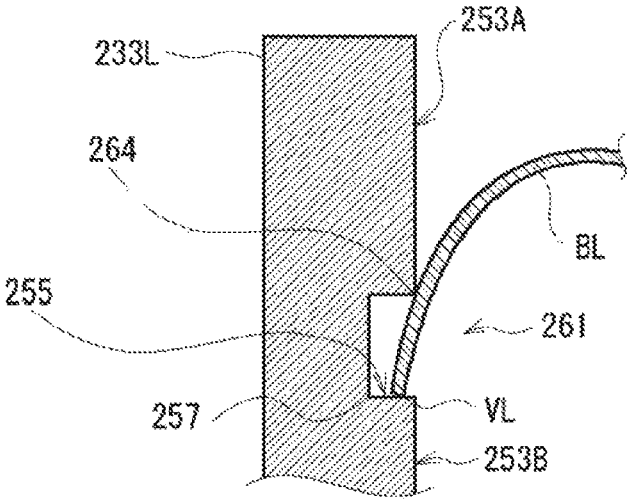
FIG. 21C is a schematic drawing illustrating support of a banknote by a groove.

As illustrated in FIG. 21B, the left rear vertex VL of the banknote BL falls into the groove 261 and moves further toward the rear while contacting the guiding valley portion 257. Then, in cases in which an angle of inclination of the left rear vertex VL and the vicinity thereof of the banknote BL have approached vertical, as illustrated in FIG. 21C, the banknote BL moves toward the rear with the left rear vertex VL contacting the support guide face 255, and the vicinity of the left rear vertex VL contacting the ridge portion 264.

When a front edge portion of the banknote BL is discharged from the discharge section 36, similarly to in the case illustrated in FIG. 13 in the first exemplary embodiment, elastic force acts to move the banknote BL so as to gradually eliminate the offset while moving toward the right direction, supported at a point at the left rear vertex VL or the left edge SL that is supported by the guiding valley portion 257 or the support guide face 255 of the left side guide 233L.

Then in the reject box 217, the left edge SL of the banknote BL contacts or slides against the valley portion rear end point 259 or the vicinity thereof, or a ridge portion 260, such that the left rear vertex VL passes above the stage arm 31B without contacting the stage arm 31B, similarly to in the first exemplary embodiment.

Namely, in the reject box 217, the upper discharge guide face 253A, the guiding valley portion 257, and the valley portion rear end point 259 or the vicinity thereof respectively function in a similar manner to the discharge guide face 53, the guiding valley portion 57, and the valley portion rear end point 59 of the reject box 17 according to the first exemplary embodiment. The reject box 217 accordingly prevents the banknotes BL from striking the stage arms 31B, similarly to in the first and second exemplary embodiments.

In the side guides 233, the grooves 261 are formed recessed from the discharge guide faces 253. The groove width and depth, namely the lengths of the groove in the up-down direction and the left-right direction, are relatively shallow. Accordingly, in the reject box 217, even when, for example, the short edges of a banknote BL are at an angle with respect to the front-rear direction, this being the direction of progress, the likelihood of the left edge SL and the vicinity thereof entering the groove 261 of the left side guide 233L when placed on the uppermost stacking face TS is kept very low.

Moreover, in the reject box 217, the groove width of the grooves 261 is relatively narrow, and so the likelihood of the left edge SL and the vicinity thereof of the banknote BL entering the groove 261 is low. In the reject box 217, even supposing that the left edge SL and the vicinity thereof of a banknote BL were to enter the groove 261 and catch (namely temporarily come to rest) on the support guide face 255, since the width of the support guide face 255 in the left-right direction is narrow, the left edge SL and the vicinity thereof would be unstable, and immediately come out of the groove 261 and fall down over the inclined slide face 256. Accordingly in the reject box 217, similarly to in the first exemplary embodiment, the left edge SL and the vicinity thereof of the banknotes BL are allowed to slide down along the inclined slide face 256, thereby stacking the banknotes BL neatly in the stacking space 30SC.

The reject box 217 is moreover capable of exhibiting similar operation and advantageous effects to the reject box 17 according to the first exemplary embodiment in other respects.

In the above explanation, in the reject box 217 according to the third exemplary embodiment, the grooves 261 are formed in the discharge guide faces 253 of the side guides 233, and the valley portion rear end points 259 are set at relatively high positions, such that the imaginary extension line XN1 passes above the upper face 31T of the stage 31. Accordingly, in the reject box 217, in cases in which a banknote BL discharged from the discharge section 36 is offset in the left-right direction, the left rear vertex VL or the right rear vertex VR of the banknote BL contacts the upper discharge guide face 253A and is then guided along the guiding valley portion 257 or the support guide face 255 toward the front. Then, in the reject box 217, the left edge SL of the banknote BL contacts or slides against the corresponding the valley portion rear end point 259 or the vicinity thereof, or the ridge portion 260. The banknote BL is thereby moved without striking the stage arms 31B, and ultimately stacked appropriately on the stage 31.

4. Other Exemplary Embodiments

Note that in the exemplary embodiments described above, explanation has been given regarding a case in which the height of the valley portion rear end points 59 of the side guides 33 are set such that the imaginary extension line XN1 (FIG. 6) that connects between the discharge point 36C of the discharge section 36 and the valley portion rear end points 59 of the side guides 33 passes above the upper face 31T of the stage 31.

However, the present invention is not limited thereto, and, for example, in cases in which the left rear vertex VL or the right rear vertex VR of a banknote BL is discovered to be moving toward the rear along the imaginary extension line XN2, the imaginary extension line XN2 may intersect the imaginary extension plane XS above the upper face 31T of the stage 31.

Figure 22:
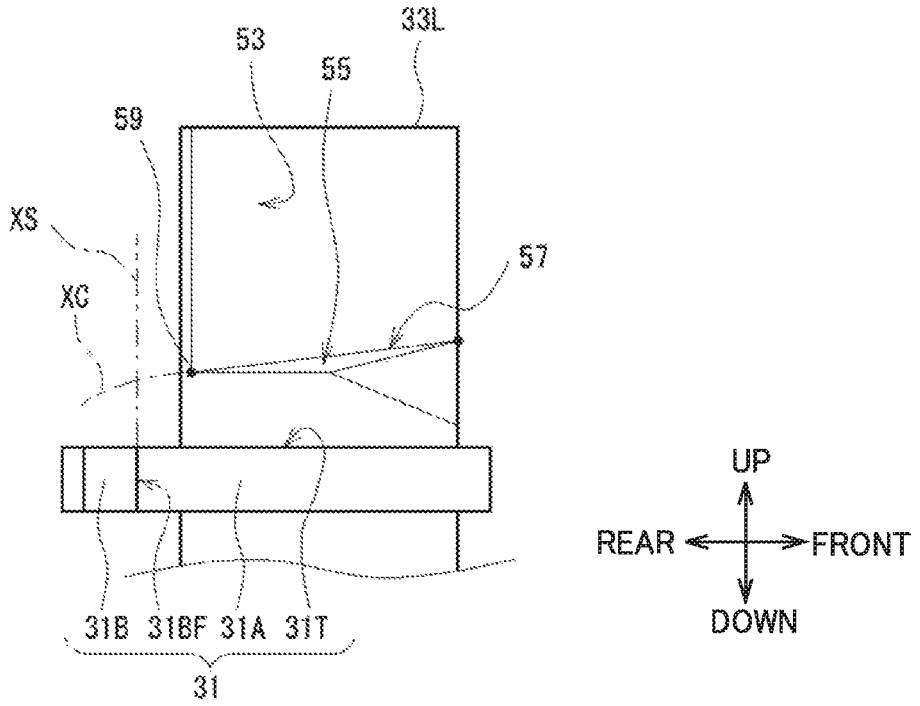
FIG. 22 is a schematic drawing illustrating a case in which a vertex of a banknote progresses along a curving line.

Moreover, as illustrated in FIG. 22 corresponding to FIG. 6, for example, in cases in which the left rear vertex VL or the right rear vertex VR of a banknote BL is discovered to be moving so as to trace an imaginary curved line XC in an imaginary parabola shape after passing the valley portion rear end point 59, the height of the valley portion rear end points 59 may be set such that the imaginary curved line XC intersects the imaginary extension plane XS above the upper face 31T of the stage 31.

Namely, in the present invention, it is sufficient that the heights of the valley portion front end points 58 and the valley portion rear end points 59 of the side guides 33 are set such that a trajectory of the left rear vertex VL or the right rear vertex VR of a banknote BL discharged from the discharge section 36 intersects the imaginary extension plane XS above the upper face 31T of the stage 31. Similar also applies to the second and third exemplary embodiments.

In the first exemplary embodiment described above, explanation has been given regarding a case in which the upper faces of the stage arms 31B and the main placement portion 31A of the stage 31 are at the same height as each other. However, the present invention is not limited thereto, and the upper faces of the stage arms 31B and the main placement portion 31A may be at different heights to each other. In such cases, it is sufficient that the heights of the valley portion rear end points 59 of the side guides 33 are set such that the imaginary extension line XN1 (FIG. 6) passes above the upper faces of the stage arms 31B. Similar also applies to the second and third exemplary embodiments.

In the first exemplary embodiment described above, explanation has been given regarding a case in which the guiding valley portions 57 (FIG. 4 and FIG. 5) are configured by portions where the flat plane shaped discharge guide faces 53 and the flat plane shaped support guide faces 55 of the side guides 33 adjacent each other in a straight line shape.

Figure 23:
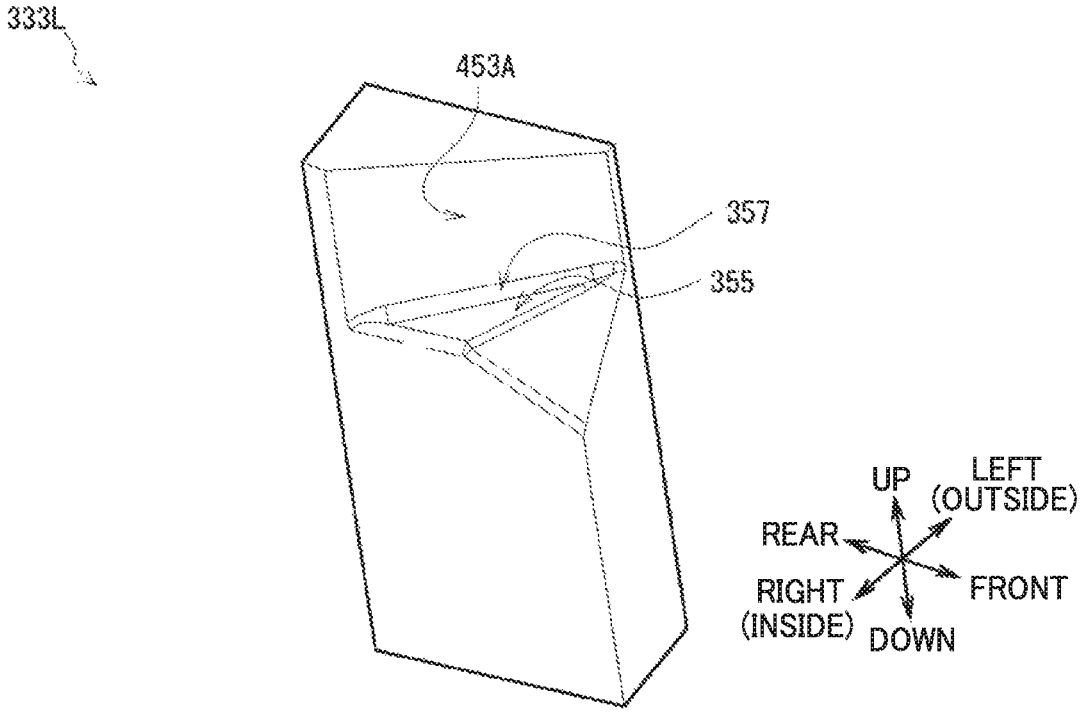
FIG. 23 is a perspective view illustrating configuration of a left side guide according to another exemplary embodiment.

However, the present invention is not limited thereto, and, for example, as in a left side guide 333L illustrated in FIG. 23 corresponding to FIG. 4, a smoothly curving curved face shaped portion with an angle of inclination changing continuously from a discharge guide face 353 to a support guide face 355 may configure a guiding valley portion 357 in place of the guiding valley portion 57. In such cases, a sliding position of the left rear vertex VL of a banknote BL is not uniform, but encompasses various positions along the curved face shaped portion, thereby preventing localized wear of the side guides 33. Similar also applies to other valley shaped portions or mountain shaped portions (ridge shaped portions) in the side guides 33, and similar also applies to the second and third exemplary embodiments.

In the second exemplary embodiment described above, explanation has been given regarding a case in which the rib shaped portion 161 is provided to the discharge guide face 153, and the support guide face 155 is at the upper face of the rib shaped portion 161. In the third exemplary embodiment, explanation has been given regarding a case in which the groove 261 is provided to the discharge guide face 253, and the support guide face 255 is at the face at the bottom of the groove 261.

Figure 24:
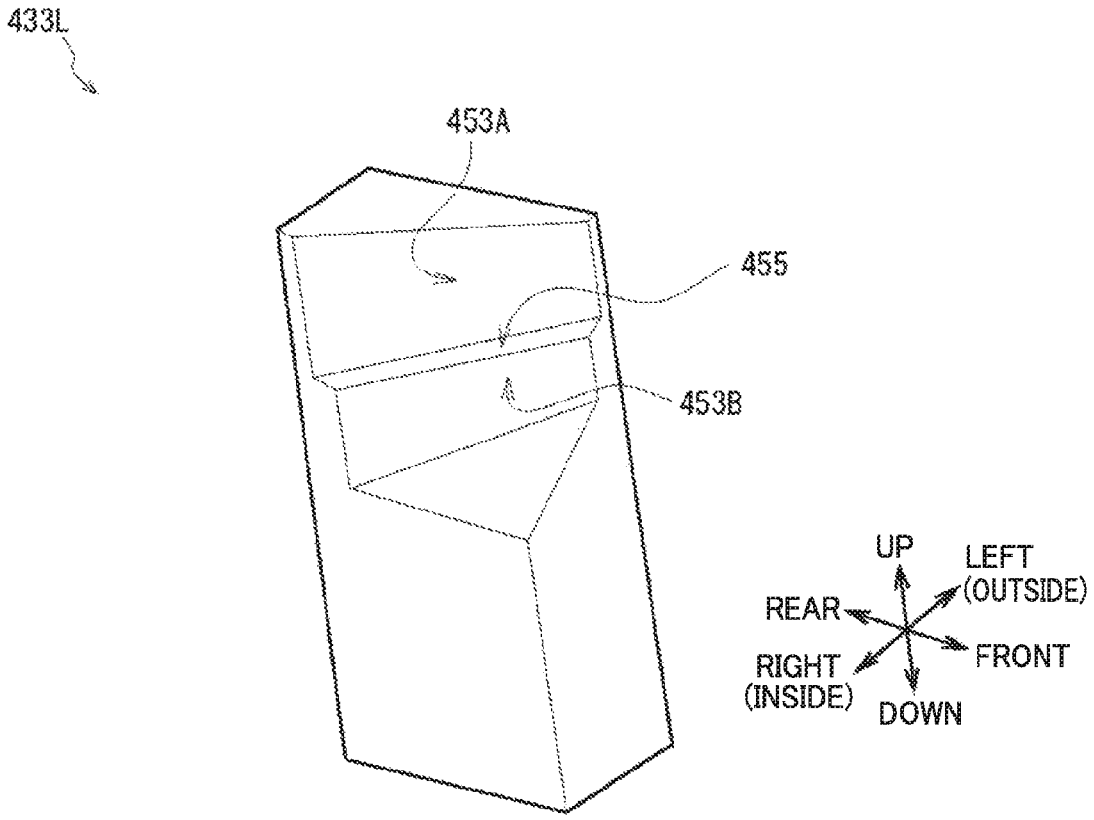
FIG. 24 is a schematic drawing illustrating configuration of a left side guide according to another exemplary embodiment.

However, the present invention is not limited thereto, and, for example, as in a left side guide 433L illustrated in FIG. 24 corresponding to FIG. 4, a step may be formed between an upper discharge guide face 453A and a lower discharge guide face 453B, and a support guide face 455 may be configured at an upper face portion of the step.

In the second exemplary embodiment described above, explanation has been given regarding a case in which the upper discharge guide face 153A and the lower discharge guide face 153B are respectively formed by dividing the discharge guide face 153 that is formed in a uniform flat plane shape into top and bottom with the rib shaped portion 161, namely, a case in which the upper discharge guide face 153A and the lower discharge guide face 153B are substantially parallel to and in the same plane as each other.

However, the present invention is not limited thereto, and, for example, the lower discharge guide face 153B may protrude out toward the right front side so as to be positioned parallel to, but not within the same plane as, the upper discharge guide face 153A. Alternatively, for example, the lower discharge guide face 153B may be non-parallel to the upper discharge guide face 153A, and a lower side of the lower discharge guide face 153B (namely an adjoining portion with the stacking guide face 154) may be inclined so as to protrude out further to the right front side than an upper side of the lower discharge guide face 153B (namely an adjoining portion with the rib shaped portion 161). Moreover, the lower discharge guide face 153B may be configured as a curved face. Similar also applies to the third exemplary embodiment and the case illustrated in FIG. 23.

In the first exemplary embodiment described above, explanation has been given regarding a case in which the inclined slide face 56 is formed between the support guide face 55 and the stacking guide face 54 (FIG. 4, FIG. 5). However, the present invention is not limited thereto, and, for example, in cases in which the support guide face 55 is set with a relatively large angle of inclination with respect to the horizontal direction, the inclined slide face 56 may be omitted, and the support guide face 55 and the stacking guide face 54 may be formed so as to adjoin each other directly.

In the first exemplary embodiment described above, explanation has been given regarding a case in which the stacking direction of banknotes on the upper face 31T of the stage 31 is the up-down direction (namely the vertical direction), and the discharge direction of banknotes into the internal space 30S by the discharge section 36 is the rear direction orthogonal thereto (namely the horizontal direction). However, the present invention is not limited thereto, and, for example, banknotes may be stacked in various directions, and banknotes BL may be discharged from the discharge section 36 in directions substantially orthogonal thereto. For example, the stacking direction of banknotes on the upper face 31T of the stage 31 may be a forward-tilted upward direction, and the discharge direction of banknotes into the internal space 30S by the discharge section 36 may be a rearward-tilted upward direction orthogonal thereto. Similar also applies to the second and third exemplary embodiments.

In the first exemplary embodiment described above, explanation has been given regarding a case in which the stage moving sections 32 are controlled by the banknote controller 11 so as to maintain the height of the uppermost stacking face TS at substantially the stacking height H2. However, the present invention is not limited thereto, and, for example, the uppermost stacking face TS may be lowered to a position a certain amount lower than the stacking height H2, and an operation to lower the uppermost stacking face TS to this position may be repeated every time the uppermost stacking face TS exceeds the stacking height H2 as a result of stacking the banknotes BL. Similar also applies to the second and third exemplary embodiments.

In the first exemplary embodiment described above, explanation has been given regarding a case in which the side guides 33 are provided to the reject box 17 that has a function of internally storing the banknotes BL conveyed by the conveyance section 13, but does not have a function of feeding out the stored banknotes BL.

However, the present invention is not limited thereto, and, for example, the side guides 33 may be provided to the banknote storage boxes 16 or the pay-in/pay-out section 12 that have a function of storing (or a function of discharging) the banknotes BL, and a function of feeding out the banknotes BL. Namely, the present invention may be applied to various locations where banknotes are at least fed out from a discharge section and stacked on a stage while restricting the position of the banknotes using side guides in a space provided with a stage that moves along a stacking direction in which banknotes are to be stacked.

In the first exemplary embodiment described above, explanation has been given regarding a case in which the present invention is applied to the reject box 17 in the banknote pay-in/pay-out device 10 of the ATM 1 that transacts banknotes, serving as a medium, with a user. However, the present invention is not limited thereto, and, for example, the present invention may be applied to a location where a medium is stacked and stored in various devices that handle various paper sheet shaped media such cash vouchers, securities, or the like. Similar also applies to the second and third exemplary embodiments.

The present invention is not limited to the respective exemplary embodiments described above and the other exemplary embodiments described above. Namely, the present invention encompasses application to exemplary embodiments combining some or all elements of the respective exemplary embodiments described above and the other exemplary embodiments described above, and exemplary embodiments deriving from elements thereof.

In the first exemplary embodiment described above, explanation has been given regarding a case in which the reject box 17, serving as a medium stacking device, includes the discharge section 36 serving as a discharge section, the stage 31 serving as a stage, the side guides 33 serving as side guides, the stage moving sections 32 serving as stage moving sections, and the stage arms 31B serving as stage arms. Each side guide includes the discharge guide face 53 serving as a discharge guide face, the support guide face 55 serving as a support guide face, and the guiding valley portion 57 serving as a guiding valley portion.

However, the present invention is not limited thereto, and a medium stacking device may include discharge sections, stages, side guides, stage moving sections, and stage arms of various configurations other than those above. A side guide may include discharge guide faces, support guide faces, and guiding valley portions of various configurations other than those above.

Moreover, in the first exemplary embodiment described above, explanation has been given regarding a case in which the ATM 1 serving as a medium transaction device includes the discharge section 36 serving as a discharge section, the stage 31 serving as a stage, the side guides 33 serving as side guides, the stage moving sections 32 serving as stage moving sections, the stage arms 31B serving as stage arms, and the banknote controller 11 serving as a controller. Each side guide includes the discharge guide face 53 serving as a discharge guide face, the support guide face 55 serving as a support guide face, and the guiding valley portion 57 serving as a guiding valley portion.

However, the present invention is not limited thereto, and a medium transaction device may include discharge sections, stages, side guides, stage moving sections, stage arms, and controllers of various configurations other than those above. A side guide may include discharge guide faces, support guide faces, and guiding valley portions of various configurations other than those above.

The disclosure of Japanese Patent Application No. 2014-093007 is incorporated in its entirety by reference herein.

All cited documents, patent applications and technical standards mentioned in the present specification are incorporated by reference in the present specification to the same extent as if each individual cited document, patent application, or technical standard was specifically and individually indicated to be incorporated by reference.

INDUSTRIAL APPLICABILITY

The present invention may be employed in various devices that store a paper sheet shaped medium discharged into a space by stacking.

The invention claimed is:

1. A medium stacking device, comprising:

a discharge section that discharges a paper sheet shaped medium into a stacking space and moves the medium in a direction of progress;

a stage that includes a placement face on which the medium is placed in the stacking space, and that stacks the medium in a stacking direction that is a direction leading away from the placement face;

side guides that are respectively disposed in a width direction, which is parallel to a sheet face of the medium and orthogonal to the direction of progress, at positions on both sides of a portion of the stage on which the medium is stacked, and that respectively guide the medium discharged from the discharge section in the width direction using a stacking guide face;

a stage moving section that moves the stage along the stacking direction such that a spacing in the stacking direction between the discharge section and the placement face of the stage is a stacking spacing appropriate for stacking the medium or larger; and a stage arm that is provided on an opposite side of the side guides to the discharge section, and that links the stage and the stage moving section together, wherein each of the side guides includes:

a discharge guide face that guides toward a central side in the width direction on progression from the discharge section along the direction of progress, a support guide face that supports the medium from a side of the stage, and a guiding valley portion that is an adjoining portion between the discharge guide face and the support guide face, that causes a vertex or edge of the medium to slide with progression of the medium, and that causes a leading edge portion of the medium in the direction of progress to pass further to a stacking direction side than the stage arm, and a guiding inclined face which is an inclined face that guides the medium toward the side of the stage, the guiding inclined face being formed between the support guide face of the guiding valley portion and the stacking guide face.

2. The medium stacking device of claim 1, wherein the guiding valley portion has a valley portion progress side end point, which is an end point of the guiding valley portion on a side of the direction of progress of the medium, and the discharge section has a discharge point where the medium is discharged, and the valley portion progress side end point is set such that a first imaginary extension line passing through the discharge point and the valley portion progress side end point passes through the stacking direction side of the stage arm.

3. The medium stacking device of claim 1, wherein the guiding valley portion has a valley portion progress side end point which is an end point of the guiding valley portion on a side of the direction of progress of the medium and is set such that an imaginary extension line, which imaginarily extends the guiding valley portion along the direction of progress of the medium, passes through the stacking-direction side of the stage arm.

4. The medium stacking device of claim 1, wherein, in the side guide, at least a portion of the support guide face is formed further to a central side in the width direction than the discharge guide face.

5. The medium stacking device of claim 1, wherein, in the side guide, at least a portion of the support guide face is formed further to an outer side in the width direction than the discharge guide face.

6. The medium stacking device of claim 1, wherein, in the side guide, the support guide face and the guiding inclined face are adjacent to each other.

7. The medium stacking device of claim 1, wherein, in the side guide, a second discharge guide face is formed between the support guide face and the guiding inclined face.

8. The medium stacking device of claim 7, wherein the second discharge guide face is substantially parallel to the discharge guide face.

9. The medium stacking device of claim 1, wherein the discharge guide face and the support guide face are joined together by a continuous curving face at the guiding valley portion of the side guide.

* * * * *